US011834233B2

(12) United States Patent
Luhrs et al.

(10) Patent No.: US 11,834,233 B2
(45) Date of Patent: Dec. 5, 2023

(54) CAP ASSEMBLY FOR DRINK CONTAINERS WITH A SLIDING SWITCH

(71) Applicant: CamelBak Products, LLC, Petaluma, CA (US)

(72) Inventors: Thomas R. Luhrs, Santa Rosa, CA (US); Ben Vierck, Petaluma, CA (US)

(73) Assignee: CAMELBAK PRODUCTS, LLC, Petaluma, CA (US)

( * ) Notice: Subject to any disclaimer, the term of this patent is extended or adjusted under 35 U.S.C. 154(b) by 282 days.

(21) Appl. No.: 16/919,106

(22) Filed: Jul. 2, 2020

(65) Prior Publication Data

US 2022/0002042 A1 Jan. 6, 2022

(51) Int. Cl.

| | |
|---|---|
| ***B65D 47/28*** | (2006.01) |
| ***B65D 41/04*** | (2006.01) |
| ***B65D 51/24*** | (2006.01) |
| ***B65D 51/16*** | (2006.01) |

(52) U.S. Cl.

CPC ..... *B65D 47/286* (2013.01); *B65D 41/0407* (2013.01); *B65D 41/0485* (2013.01); *B65D 41/0492* (2013.01); *B65D 51/1672* (2013.01); *B65D 51/242* (2013.01); *B65D 51/245* (2013.01)

(58) Field of Classification Search

CPC ..... B65D 47/286; B65D 41/0407; B65D 41/0485; B65D 41/0492; B65D 51/1672; B65D 51/242; B65D 51/245

USPC ..... 220/715

See application file for complete search history.

(56) References Cited

U.S. PATENT DOCUMENTS

| | | | | |
|---|---|---|---|---|
| 5,199,597 | A * | 4/1993 | Gladish | A47G 19/2272 220/348 |
| 8,985,370 | B2 * | 3/2015 | Lane | A45F 3/18 220/252 |
| 9,113,698 | B2 | 8/2015 | Blain et al. | |
| 9,456,710 | B2 * | 10/2016 | Blain | A45F 3/18 |

OTHER PUBLICATIONS

Definition of "switch". Merriam-Webster Dictionary Online. Merriam-Webster2023. https://www.merriam-webster.com/dictionary/switch (Year: 2023).*

* cited by examiner

*Primary Examiner* — James N Smalley

(74) *Attorney, Agent, or Firm* — Amardeep S. Grewal; Gerard M. Donovan; Reed Smith LLP

(57) ABSTRACT

Drink containers include a liquid container and a cap assembly removably coupled to the liquid container. Cap assemblies include a switch, a trigger and seal bar. Upon actuating the trigger the seal bar slides back to form a drink outlet opening in the cap assembly. To hold the seal bar in an open state without additional external force from the user, the switch is slid from an unlocked position to a locked positon, thereby keeping the drink outlet and a vent formed in the cap assembly open in order to cool down a warm beverage in the liquid container.

20 Claims, 21 Drawing Sheets

CAP ASSEMBLY FOR DRINK CONTAINERS WITH A SLIDING SWITCH

BACKGROUND

Beverage containers come in a variety of configurations and are used to carry a variety of beverages for consumption by a user. Generally, beverage containers comprise a container and a cap assembly, wherein the cap assembly is removably coupled to the container. The cap assemblies generally include a cover to prevent a beverage contained in the container from spilling out of the container. In order to drink the beverage from the container, the user has to constantly engage the cover by applying external force in order to consume the beverage. The conventional cap assemblies used in drink containers, however, lack the structural features required to keep the cover open without requiring further engagement from the user. As such, there is a need in the art to develop novel cap assemblies that allow the cover to be propped open without requiring further engagement from the user.

SUMMARY

Drink containers and corresponding cap assemblies are disclosed herein. With respect to structural configurations of the cap assembly and liquid container, U.S. Pat. No. 9,113,698, titled "Drink Containers and Cap Assemblies," is incorporated herein by reference in its entirety.

According to example embodiments discussed herein, a cap assembly is disclosed, which comprises a seal bar, a trigger, and a switch. The seal bar extends along a top surface of the cap assembly and configured to translate between a forward position, in which the seal bar blocks a drink outlet on a proximal end of the cap assembly, and a back position, in which the seal bar exposes the drink outlet. The trigger is coupled to the seal bar on a rear end of the cap assembly opposite to the proximal end of the cap assembly, wherein the trigger is configured to transition between a rest position and an actuated position based upon application of a force to the trigger to thereby translate the seal bar between the forward position and the back position. And, the switch is on the rear end of the cap assembly and positioned on an outer surface of the trigger, wherein the switch is configured to slide between a locked position and an unlocked position. Further, the seal bar is maintained in the back position to expose the drink outlet upon transitioning the trigger to the actuated position and subsequently sliding the switch in the locked position. The seal bar is configured to translate to the forward position upon the trigger being in the rest position and the switch in the unlocked position. And, the switch comprises indentations for engagement by a user; the indentations are on the rear end of the cap assembly.

According to the example embodiments, the cap assembly further comprises a vent positioned beneath a vent seal. The vent seal is configured to open the vent upon transitioning the trigger in the actuated position, and close the vent upon transitioning the trigger in the rest position. The vent is maintained open upon the subsequent sliding of the switch in the locked position after transitioning of the trigger is in the actuated position. The cap assembly may also further comprise a handle extending away from the proximal end of the cap assembly, the handle forming an opening between the switch and a proximal portion of the handle.

Further, according to the example embodiments, the cap assembly further comprises an orifice in the top surface forming a passage between the outside and inside of the cap assembly, the passage of the orifice being open upon the vent being open, and one or more status indicators on the rear end of the cap assembly and adjacent to the switch. The one or more status indicators correspond to whether the switch is in the locked position or the unlocked position.

The switch of the cap assembly is configured to transition towards a proximal end of the cap assembly upon a bottom portion of the trigger transitioning towards the proximal end of the cap assembly. The seal bar comprises a pair of seal bar tines configured to engage the drink outlet upon the seal bar translating in the forward position; the pair of seal bar tines correspond to projections that are spaced apart from each other. Further, the pair of seal bar tines are configured to extend towards the proximal end of the cap assembly and away from the switch and the trigger upon the pair of seal bar tines engaging the drink outlet.

The seal bar of the cap assembly comprises a bottom portion and a top portion, the top portion comprises a closed structure, and the bottom portion comprises a hollow cavity formed therein. The hollow cavity is formed between the top portion of the seal bar and the top surface of the cap assembly. Wherein, the top portion of the seal bar is in contact with the drink spout upon the seal bar translating to the forward position.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and in the claims, the singular form of "a," "an," and "the" include plural referents unless the context clearly dictates otherwise.

BRIEF DESCRIPTION OF THE DRAWINGS

The disclosed aspects will hereinafter be described in conjunction with the appended drawings, provided to illustrate and not to limit the disclosed aspects, wherein like designations denote like elements.

DETAILED DESCRIPTION

Various aspects of the novel apparatuses are disclosed herein are described more fully hereinafter with reference to the accompanying drawings. This disclosure can, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein, one skilled in the art would appreciate that the scope of the disclosure is intended to cover any aspect of the novel apparatuses disclosed herein, whether implemented independently of, or combined with, any other aspect of the disclosure. For example, an apparatus may be implemented using any number of the aspects set forth herein. It should be understood that any aspect disclosed herein may be implemented by one or more elements of a claim.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, and/or objectives. The detailed description and drawings are merely illustrative of the disclosure rather than limiting the scope of the disclosure being defined by the appended claims and equivalents thereof.

Figure 1A:
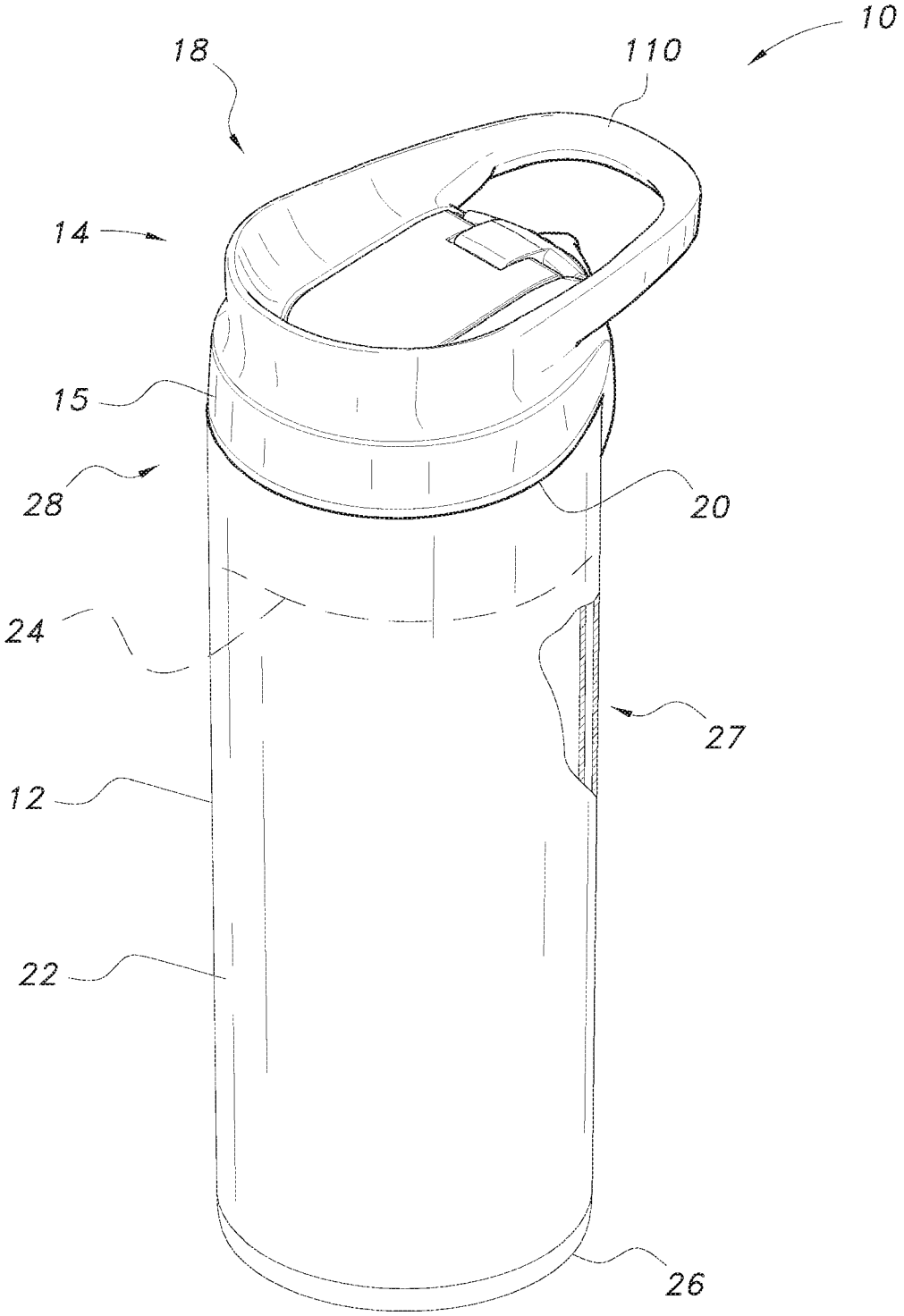
FIG. 1A is a perspective view of a drink container comprising a cap assembly and a drink container according to an example embodiment.

FIG. 1A is a perspective view of a drink container 10 according to an example embodiment. The drink container 10 comprises a cap assembly 14, a liquid container 12, and a coupling assembly 28. The coupling assembly 28 is configured to removably couple the cap assembly 14 and the liquid container 12. The cap assembly 14 further includes a handle 110, an operational assembly 18, and a body 15. The handle 110 is defined by the body 15 of the cap assembly 14 such that the handle 110 protrudes outward in the rear-end direction of the cap assembly 14, thereby defining an opening or cavity between the handle 110 and a switch 100 coupled to the rear end of the cap assembly 14. The operational assembly 18 provides a mechanism that enables a user to selectively unseal and reseal a drink outlet 16, shown in FIG. 7A, for selective dispensing of drink liquid 24 from the liquid container 12 through the drink outlet 16.

The body 15 of cap assembly 14 may take any suitable form and may be defined by a monolithic structure or by an assembly of more than one structure. Typically, the body 15 may be constructed of plastic and/or metal and will define a drink spout 38 associated with the drink outlet 16, shown in FIG. 7A. The drink spout 38 is configured and shaped to be engaged by a user's mouth to receive the drink liquid 24 from the liquid container 12 as it is dispensed through the drink outlet 16, for example by a user tilting the liquid container 12 in a drinking motion associated with consuming of the drink liquid 24 from the liquid container 12.

The liquid container 12 comprises an internal compartment 22, a double-walled construction 27, and a neck 20. Liquid container 12 may include an open neck 20, through which drink liquid 24 may be selectively poured, or otherwise dispensed, into an internal compartment 22 of the liquid container 12. The neck 20 defines an opening through which drink liquid 24 may be added to or removed from the liquid container. In turn, when cap assembly 14 is operatively coupled to the liquid container 12, the drink liquid 24 may be dispensed only through the drink outlet 16 of the cap assembly 14. The double-walled construction 27 in the liquid container 12 utilizes a space, or volume, between the walls to be filled with a solid, liquid, and/or gaseous insulating material. When drink containers 10 include a thermally insulated liquid container, the drink containers may be referred to as, described as, and/or otherwise be a thermally insulated drink container, a thermally insulated beverage container, a vacuum bottle, a travel mug, a travel container, a portable coffee mug, etc. Cap assembly 14 additionally or alternatively may be thermally insulated and may include a double-walled, or other thermally insulated, construction, and optionally may include at least one layer of insulating material other than the walls that form the outer surfaces of the cap assembly 14.

Figure 1B:
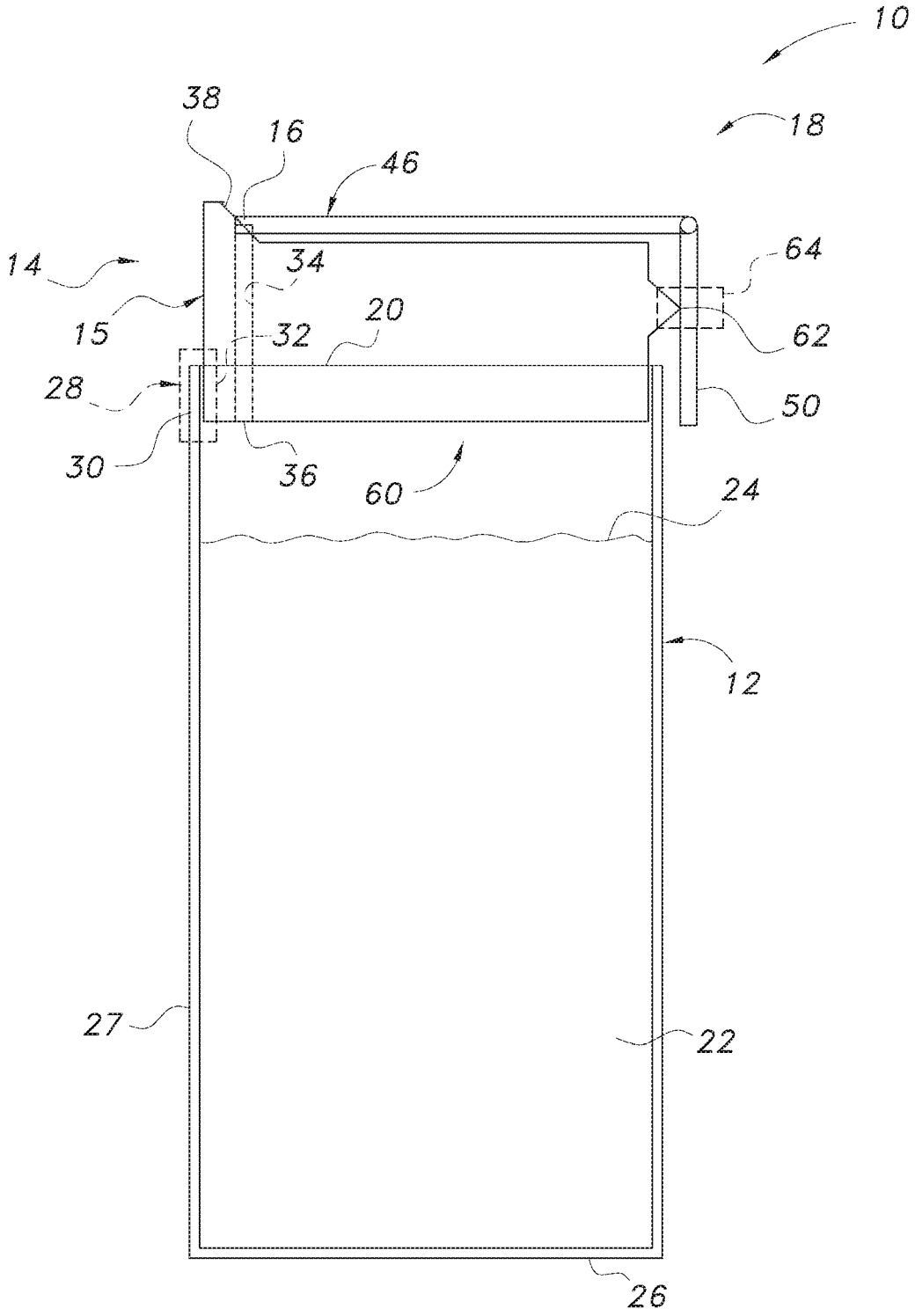
FIG. 1B is a perspective view of a cross-section of the drink container illustrated in FIG. 1A.

FIG. 1B is a perspective view of a cross-section of the drink container illustrated in FIG. 1A. FIG. 1B illustrates in further detail the cap assembly 14 and the coupling assembly 28. Coupling assembly 28 includes coupling structures 30 and 32, with liquid container 12, including coupling structure 30, and with cap assembly 14, including coupling structure 32, which is configured to selectively mate with coupling structure 30. In such an embodiment, the neck 20 of the liquid container 12 may include coupling structure 30.

Coupling assembly 28 may provide a liquid-tight connection between the cap assembly 14 and the liquid container 12. When such a connection is established between the cap assembly 14 and the liquid container 12, the cap assembly 14 may restrict liquid from being dispensed from the liquid container 12 other than through drink outlet 16.

Illustrative, non-exclusive examples of the coupling assembly 28 that may be incorporated into drink containers according to the present disclosure include (but are not limited to) threads, snap-fit arrangements, friction-fit arrangements, clasp arrangements, etc. Further, with respect to the cap assembly 14, the cross-section illustrates a passage, or conduit 34, through which drink liquid 24 from the internal compartment 22 of the liquid container 12 may be selectively dispensed from an inlet 36 to drink outlet 16. Passage 34 may alternatively be referred to as a drink passage, a liquid passage, an outlet conduit, and/or a dispensing passage. The inlet 36 of the passage 34 refers to the portion of the passage that is closest to the internal compartment 22 of the drink container 10 and into which drink liquid 24 first passes from the internal compartment 22 of the drink container 10 as the drink liquid 24 is dispensed through the passage 34. The drink liquid 24 passes from the internal compartment 22 of the drink container 10 as the drink liquid 24 is dispensed from the passage 34 to a user.

Further, in FIG. 1B, a box 64 is schematically illustrated in an overlapping relationship with the body 15 of the cap assembly 14 and a trigger 50 of the operational assembly 18. Box 64 schematically represents that the cap assembly 14 and/or the operational assembly 28 may include such additional structures as an axle, a spring, and/or other structures that operatively couple, and in some embodiments pivotally couple and/or bias, the trigger 50 to the base of the cap assembly 14.

Figure 1C:
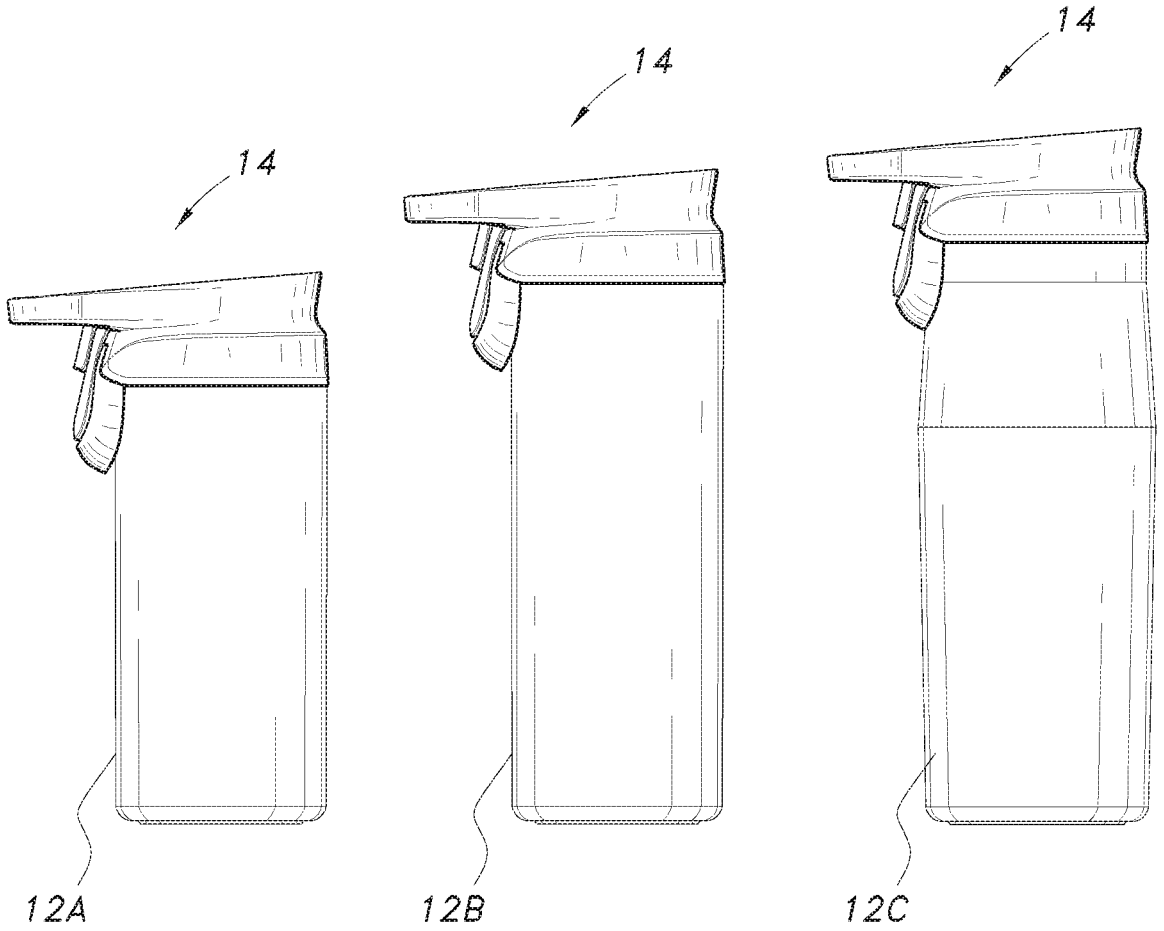
FIG. 1C is a perspective view of three different sizes of the drink container illustrated in FIG. 1A.

Additionally, as shown in FIG. 1C, three different sizes of the drink container 10 with the cap assembly 14 shown in FIG. 1A are illustrated in FIG. 1C. As represented, the liquid container 12 can have three different sizes. For instance, these sizes include 12 ounces (oz), 16 oz, and 20 oz, as represented by liquid containers 12A, 12B and 12C. However, one skilled in the art would appreciate that size of the liquid containers may not be limited to such configurations, and may include smaller or larger sizes that are within the scope of the present disclosure. Further, as shown in FIG. 1C, liquid container 12C representing 20 oz may additionally include a curvature, or bend in its outer surface, for ease of use and gripping by a user while holding the liquid container 12C or drinking therefrom.

Figure 2:
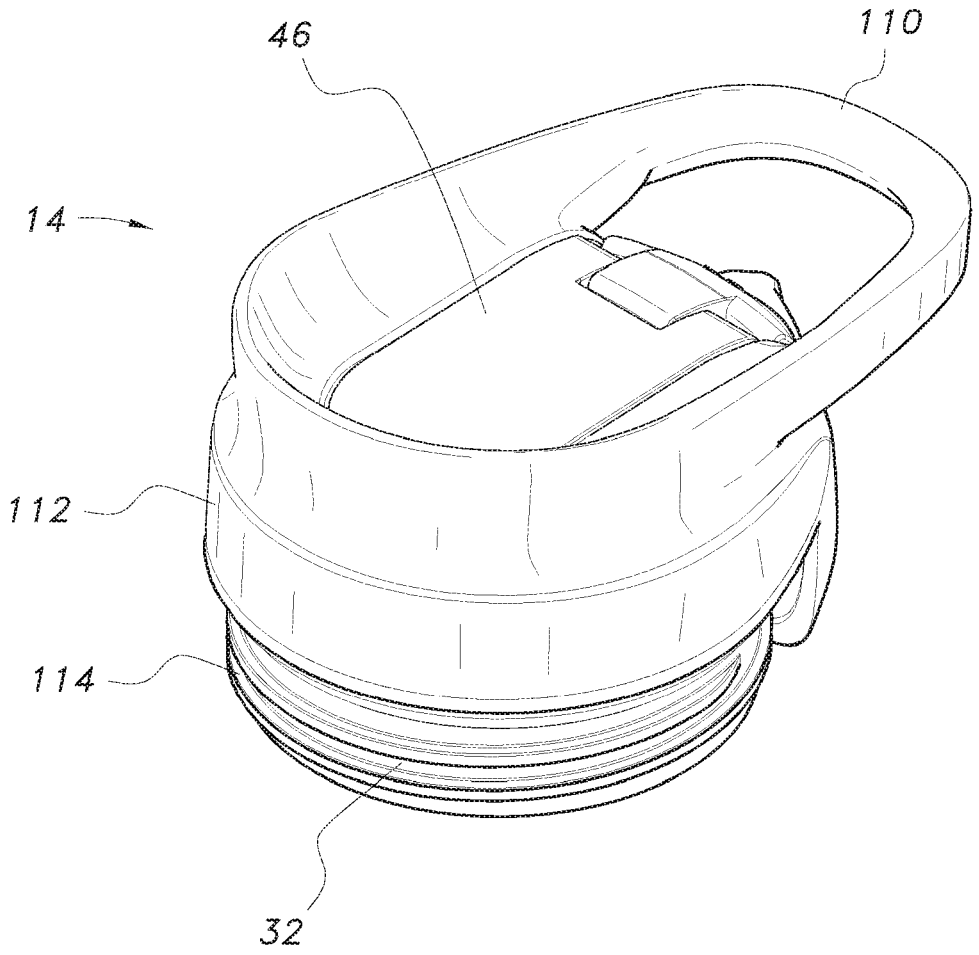
FIG. 2 is a perspective view of the front end of the cap assembly illustrated in FIG. 1A.

Next, the cap assembly 14 will be discussed in further detail with respect to FIGS. 2-6, 7A-B, 8A-C, and 9-10, for example. FIG. 2 is a perspective view of the front end of the cap assembly 14 illustrated in FIG. 1A. As represented, the cap assembly 14 comprises a seal bar 46, the handle 110, an upper body 112, a lower body 114, and coupling structures 32. The seal bar 46, which is positioned at a top surface of the cap assembly 14, extends along a horizontal plane between the front end and the rear end of the cap assembly 14. The functionality and operation of the seal bar 46 will be further discussed below. The body 15 of the cap assembly 14 comprises the upper body 112 and the lower body 114, with the lower body 114 defining coupling structure 32 in the form of threads that mate with corresponding threads of the liquid container 12. The cap assembly 14 may also include a circular seal, or O-ring, or gasket, 115 (shown in FIG. 18) above the threads that serves to improve a seal between the cap assembly 14 with the liquid container 12 when operatively coupled together.

Figure 3A:
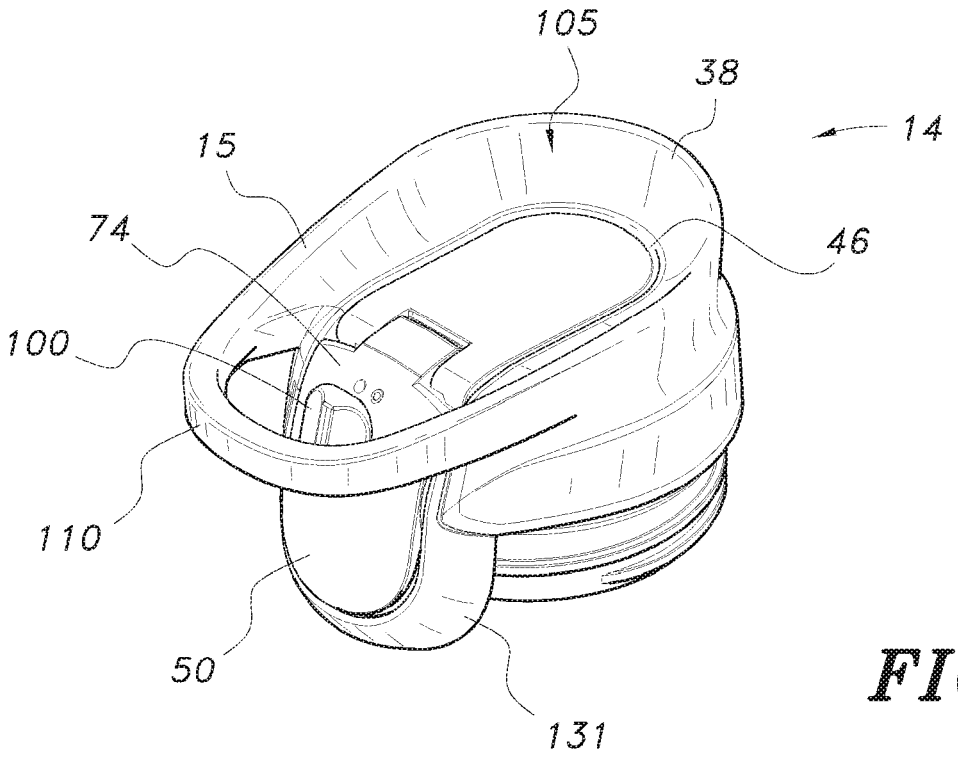
FIGS. 3A-B are a perspective views of the rear end of the cap assembly illustrated in FIG. 1A.
Figure 3B:
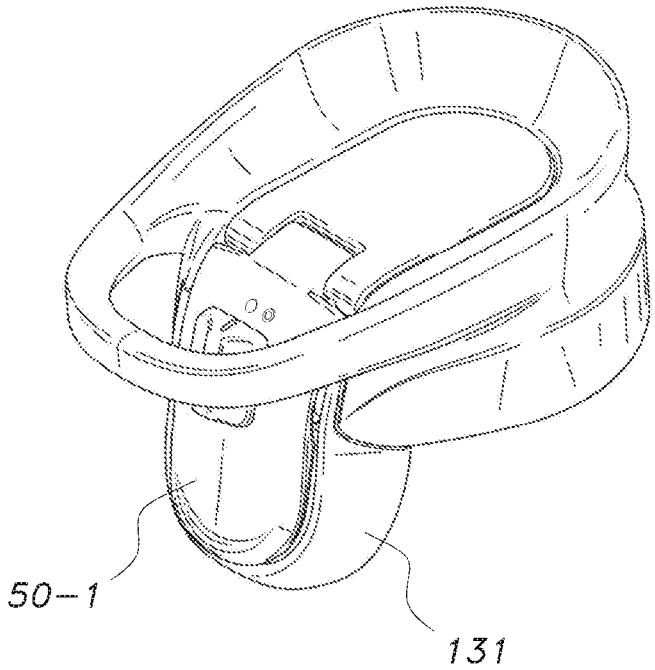
Figure 8A:
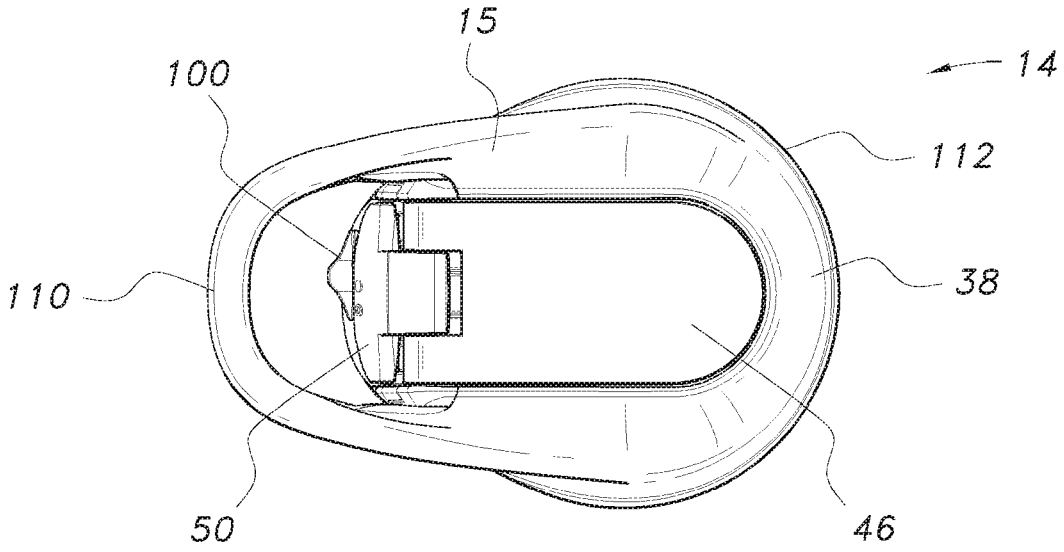
FIG. 8A is a top view of the cap assembly illustrated in FIG. 1A with the seal bar of the cap assembly in a closed state and the switch in an unlocked configuration.
Figure 8B:
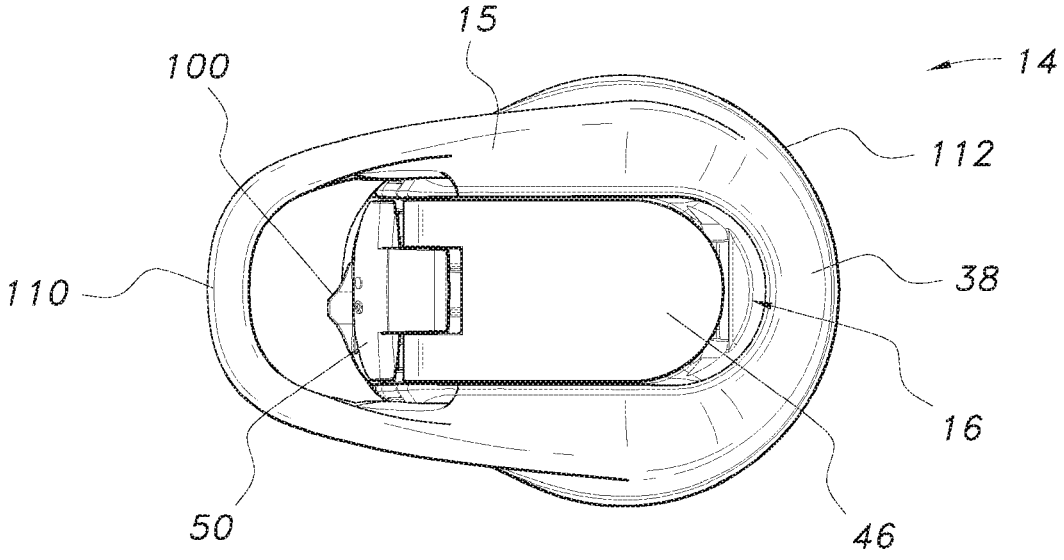
FIG. 8B is a top view of the cap assembly illustrated in FIG. 1A with the seal bar of the cap assembly in an open state and the switch in an unlocked configuration.
Figure 8C:
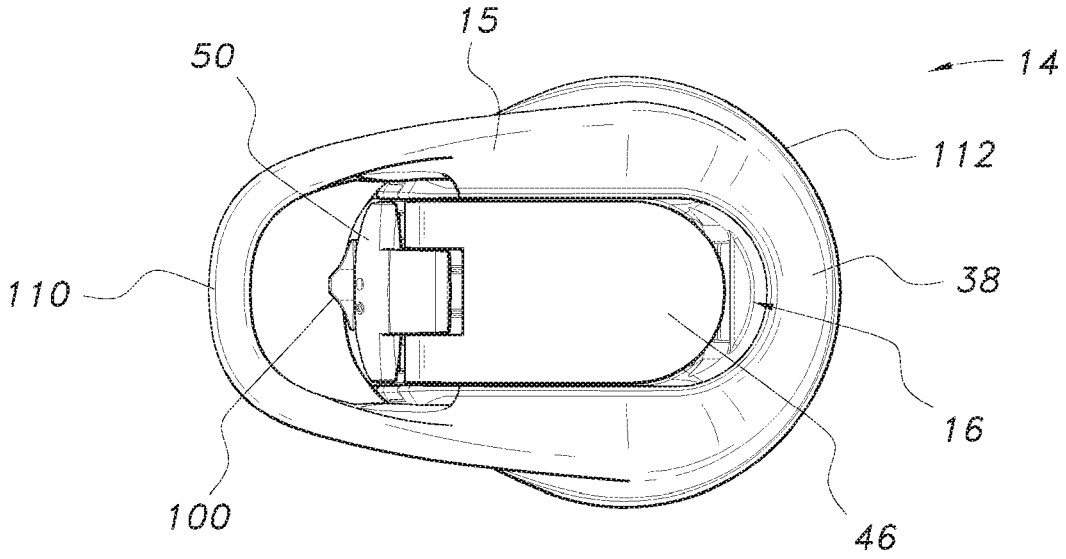
FIG. 8C is a top view of the cap assembly illustrated in FIG. 1A with the seal bar of the cap assembly in an open state and the switch in a locked configuration.

With respect to FIGS. 3A-B, a perspective view of a rear end of the cap assembly 14 illustrated in FIG. 1 is shown. The rear end of the cap assembly 14 further illustrates the cap assembly 14 comprising a trigger 50, a u-shaped member 131, a switch 100, a plurality of or at least one status indicator 74, and a cup-shaped or bowl-shaped upper surface 105 that defines the drink spout 38. With respect to the trigger 50, which is part of the operational assembly 18, it is configured to be selectively engaged by a user to selectively reconfigure the operational assembly 18 from the closed configuration to the open configuration. In other words, actuation of the trigger 50 results in actuating the seal bar 46 between an open and closed configuration as shown in FIGS. 8A-C and further discussed in detail below.

In some embodiments, the trigger 50 may be biased, such as spring biased, such that the operational assembly 18 is biased toward the closed configuration upon release of pressure on the trigger 50 or disengagement from the user. In some embodiments, the trigger 50 may be configured to be selectively pivoted relative to the body 15 of the cap assembly 14 to reconfigure the operational assembly 18 from the closed configuration to the open configuration, as shown in FIGS. 8A-B. In FIG. 1B, a pivot axis 62 is schematically presented, about which the trigger 50 may be pivoted. However, other configurations of the triggers 50 are also within the scope of the present disclosure, including actuators that generally translate linearly in response to user engagement thereof, such as by a user pressing on the actuator.

Further, as illustrated in FIG. 3A, the trigger 50 nests within a u-shaped member 131, which may be made of plastic or similar material, that generally extends around the trigger 50 and that provides an ergonomic feel for the trigger and the drink container 10 when held by a user. The u-shaped member 131 is fixed relative to the body 15 of the cap assembly 14 with a pair of screws 133, shown in FIG. 18, and the trigger 50 pivots relative to the u-shaped member 131. The u-shaped member 131 additionally or alternatively may be described as a guard, or housing, for the trigger 50, as the member 131 restricts objects from lodging under the trigger 50 (which may prevent use of the trigger) and/or to restrict unintentional actuation of the trigger 50, such as if the drink container 10 tips over and the trigger 50 contacts a hard surface.

The switch 100 and status indicators 74 shown in FIG. 3A are also part of the operational assembly 18. The switch 100 is configured to slide or translate between left and right directions, which are representative of locked and unlocked positions of the switch 100. The sliding of the switch 100 enables the user to keep the seal bar 46 in an open state by locking the seal bar 46 in an open state, as shown and discussed below with respect to FIG. 8C, thereby allowing venting of the drink liquid 24 in the liquid container 12. The functionality of the switch 100 is further discussed in detail with respect to FIGS. 11-12 and 14A-B. The status indicators 74 above the switch 100 provide indication to the user as to whether the switch 100 is in a locked or unlocked position. FIG. 3B illustrates an alternative embodiment of the trigger 50 in the cap assembly 14, which includes a recessed or indented portion 50-1 that allows for a user to rest his or her finger, or engage against the same, as the trigger 50 is actuated or compressed.

Figure 4:
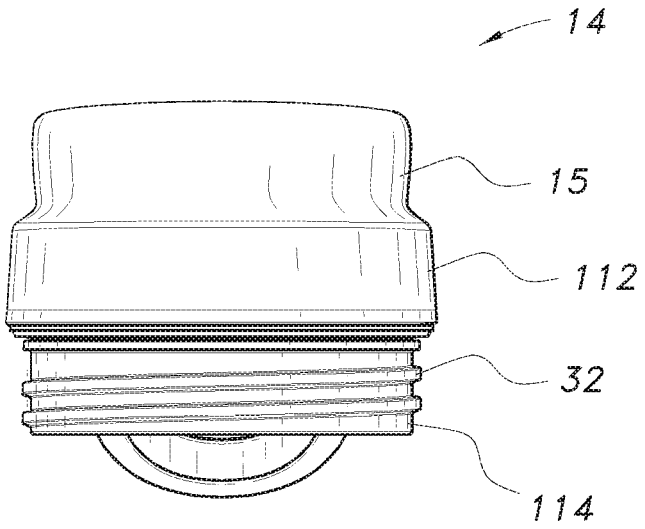
FIG. 4 is a front view of the front end of the cap assembly illustrated in FIG. 1A.
Figure 5:
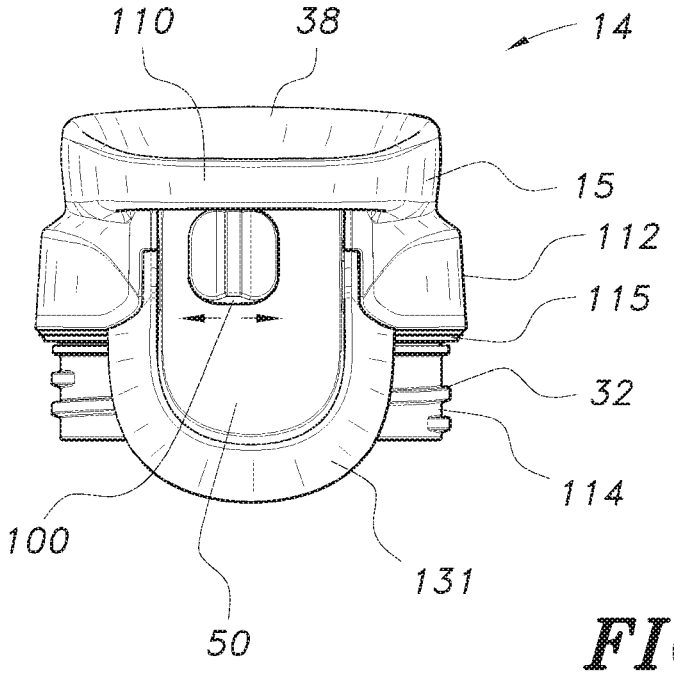
FIG. 5 is a front view of the rear end of the cap assembly illustrated in FIG. 1A.
Figure 6:
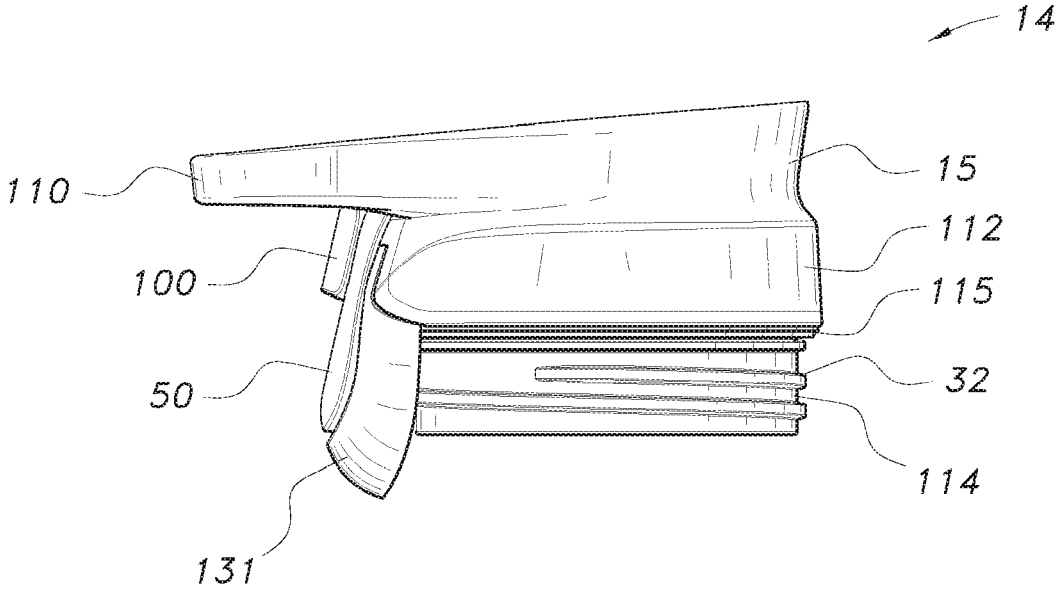
FIG. 6 is a side view of the cap assembly illustrated in FIG. 1A.
Figure 7A:
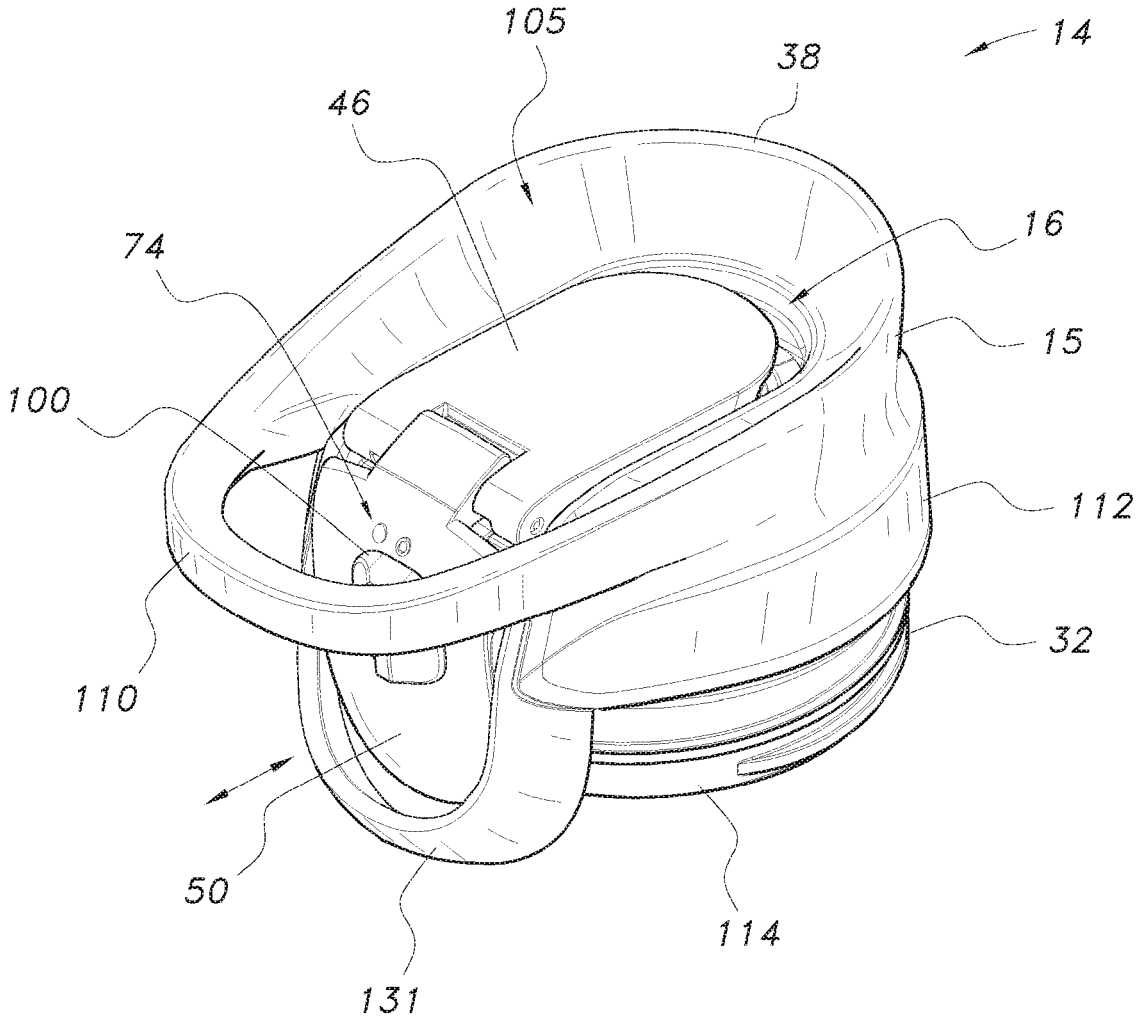
FIG. 7A is a perspective view of the rear end of the cap assembly illustrated in FIG. 1A with a seal bar of the cap assembly in an open state.

Next, FIG. 4 illustrates a front view of the front end of the cap assembly 14 illustrated in FIG. 1. As represented in the figure, the body 15 includes the upper body 112 and the lower body 114, which therein defines the coupling structures 32 as discussed above. Next, FIGS. 5-6 will be discussed, which are rear and side views of the cap assembly 14, as illustrated in FIG. 1A. As shown in further detail, the switch 100 protrudes or projects out of the face of the trigger 50 and towards the handle 110. As annotated by the arrows in FIG. 5, the switch 100 can be configured to slide either in left or right directions. The left and right directions represent the switch 100 being in a locked or unlocked state. The sliding of the switch 100 can be done while the trigger 50 is either in an actuated or unactuated position. If the switch 100 is slid into the locked position, from the unlocked position, while the trigger 50 is in the unactuated position, the user would be unable to, or prevented from, actuating the trigger 50. Once the switch 100 is in the unlocked position, the user can then actuate the trigger 50, which thereby slides the seal bar 46 to form drink outlet 16 as illustrated in FIG. 7A. In the event the switch 100 is slid into the locked position after the trigger 50 is actuated, the seal bar 46 is held in an open position, as shown and discussed below with respect to FIG. 8C. According to an example embodiment, a user may actuate the trigger 50 separately from the switch 100 such that the user may actuate the trigger 50 first and then slide the switch 100.

Figure 13:
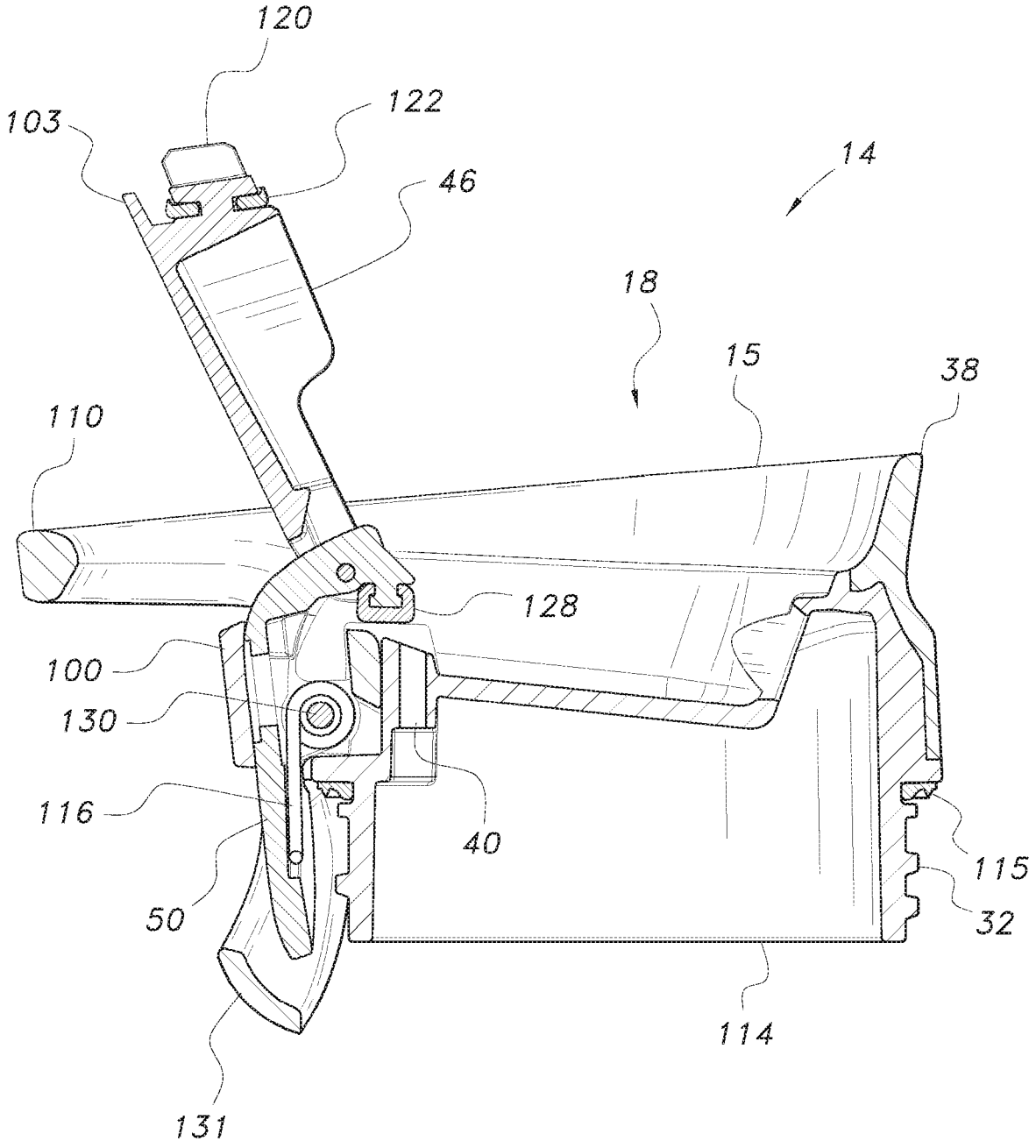
FIG. 13 is a cross-section of the cap assembly illustrated in FIG. 1A in a cleaning mode state.
Figure 15:
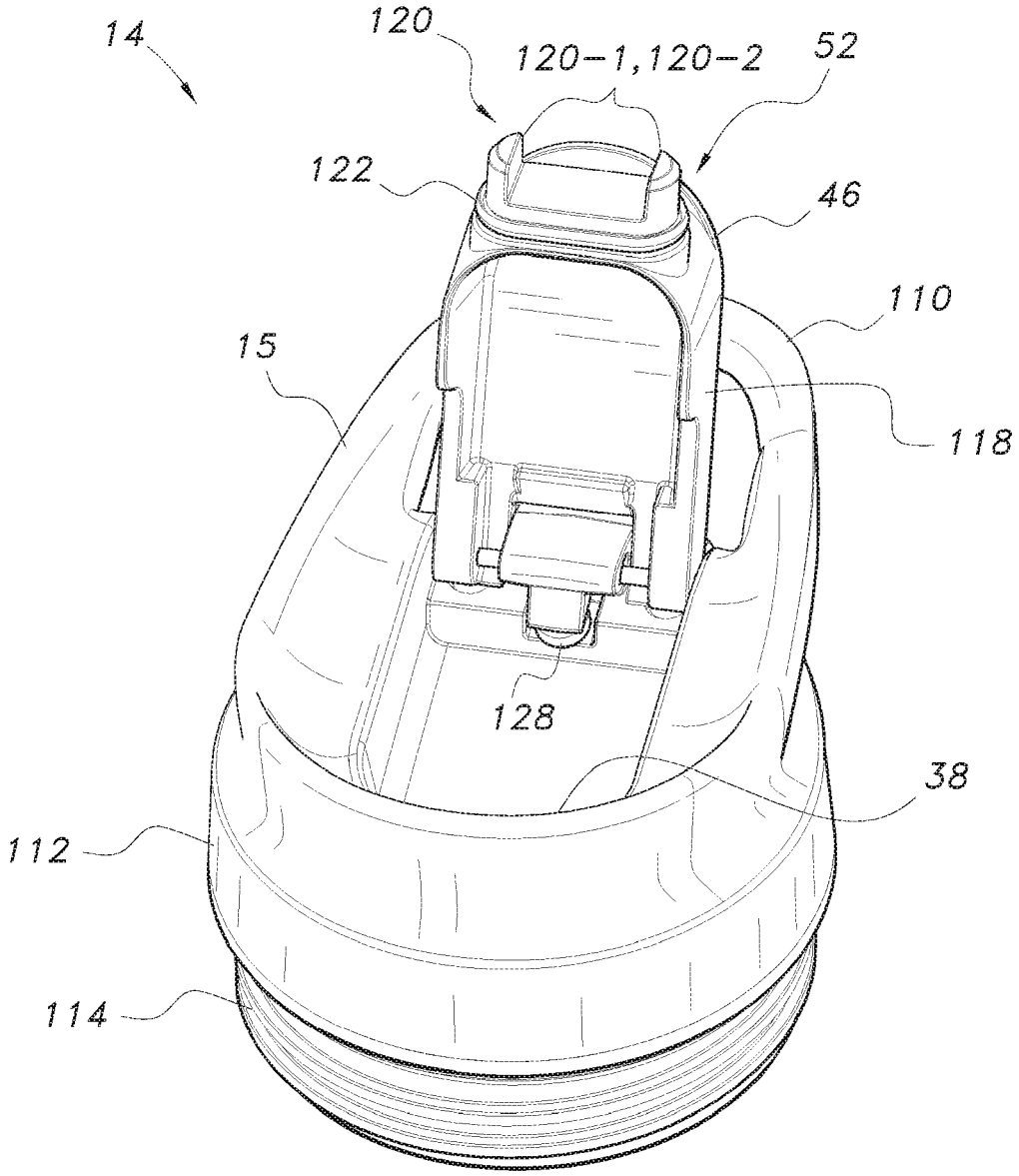
FIG. 15 is a perspective front view of the cap assembly illustrated in FIG. 1A in the cleaning mode.
Figure 18:
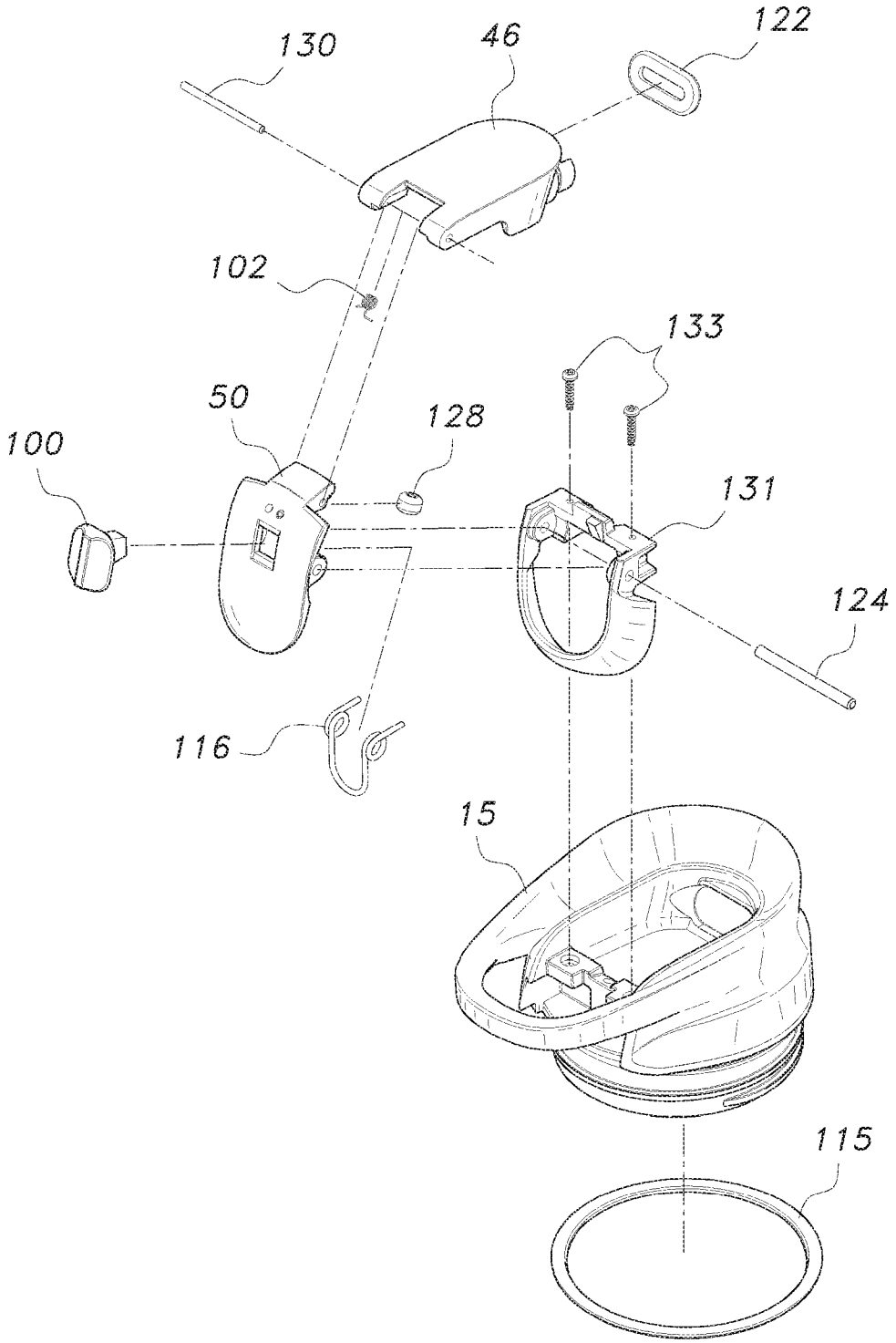
FIG. 18 is an exploded view of the cap assembly illustrated in FIG. 1A.

Next, FIG. 7A will be discussed which is a perspective view of the rear end of the cap assembly 14 illustrated in FIG. 1 with the seal bar 46 of the cap assembly 14 in an open state. As shown in FIG. 7A, the trigger 50 is in an actuated state as it is depressed inward upon application of an external force by a user, as represented by the arrow. Upon actuating, a bottom portion of the trigger 50 pivots inward relative to the u-shaped member 131 and toward the lower body 114 of the cap assembly 14, while a top portion of the trigger 50 remains in place relative to the body 15 of the cap assembly 14. The trigger 50, which is connected to the seal bar 46 via a pin or axle 130 and a cleaning position spring 102, as shown in FIG. 18, slides the seal bar 46 back upon actuation of the trigger 50. The cleaning position spring 102, which may be in the form of a spring, allows the seal bar 46 to prop open in an extended manner as shown in FIGS. 13 and 15. Stated differently, the actuation of the trigger 50 causes the seal bar 46 to pivot back, which in turn creates an opening or a drink outlet 16 through which drink liquid 24 may be selectively dispensed to a user. The drink outlet 16 may take any suitable form and may be described as being defined by a passage, or conduit, 34 through which drink liquid 24 from the internal compartment of the liquid container 12 may be selectively dispensed from an inlet 36 to drink outlet 16.

Figure 7B:
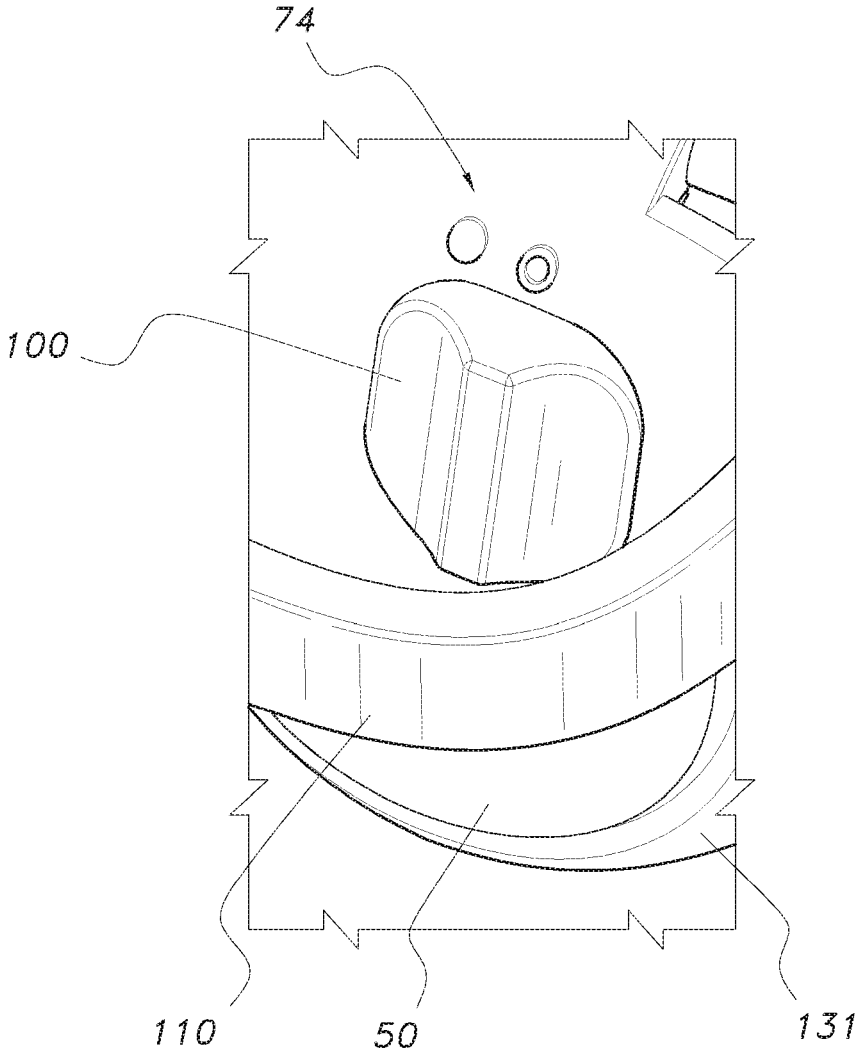
FIG. 7B is a perspective view of a switch and status indicators on the rear end of the cap assembly illustrated in FIG. 1A.

Next, FIG. 7B will be discussed, which is a perspective view of a switch 100 and status indicators 74 on the rear end of the cap assembly 14. The switch 100 may include a contoured or recessed surface on either side to assist in engagement by a user. That is, as a user slides the switch 100 in either the left or right side, the recessed or contoured grooves aid the user to do so. Further, the switch 100 may be aligned with status indicators or icons 74, which aid the user in determining whether the switch 100 is in a locked or unlocked state. For example, the status indicators 74 may include a filled circle and an unfilled circle that correspond to a locked state and an unlocked state of the switch 100, respectively. The switch 100 may be in a locked or unlocked state by sliding the switch 100 in either left or right direction. As noted above, and further discussed below, once the switch 100 is in a locked state, after actuating of the trigger 50, the seal bar 46 is continuously held in an open state, preventing the seal bar 46 from sliding or moving forward, thereby maintaining an opening or a drink outlet 16. Whereas, if the switch 100 is in an unlocked state, the seal bar 46 moves back into a closed position once the trigger 50 is in the unactuated state. Stated differently, once the external force from a user on the trigger 50 is withdrawn, the trigger 50 goes back to its original position, which therein results in the seal bar 46 going back to the closed state, as long as the switch 100 remains in the unlocked state.

With respect to the design or structural configuration of the switch 100 and the status indicators 74, one skilled in the art will appreciate that various other designs are within purview of the present disclosure. For instance, the switch 100 may include additional contours or grooves, and the status indicators 74 may be represented differently by having a water droplet with a line there through, while not departing from the functionality as discussed herein. Moreover, with respect to positioning of the switch 100, one skilled in the art may appreciate that positioning of the switch 100 at a top portion of the trigger 50 is not limiting to the present disclosure. The switch 100 may be positioned at a bottom or middle portion of the trigger 50 and equivalently function in its locked or unlocked state upon translation by a user.

Next, FIGS. 8A-C will be discussed in further detail. FIG. 8A is a top view of the cap assembly 14 illustrated in FIG. 1 with the seal bar 46 of the cap assembly 14 in a closed state and the switch 100 in an unlocked configuration. In this configuration, the trigger 50 is in an unactuated state as there is no external force applied by the user. Without application of an external force, the trigger 50 does not pivot as discussed above with respect to FIG. 7A. Being in an unactuated state, the seal bar 46 does not slide back, and as such no opening or drink outlet 16 is formed for a user to access the drink liquid 24 from the liquid container 12.

Next, FIG. 8B is also a top view of the cap assembly 14 with the seal bar 46 of the cap assembly 14 in an open state or position and the switch 100 in an unlocked configuration. In other words, upon actuating the trigger 50, as shown in FIG. 7A, the seal bar 46 slides back resulting in an opening or formation of a drink outlet 16. The moving or sliding back of the seal bar 46 results in the drink outlet 16 forming in the cap assembly 14 that was not present when the trigger 50 was in an unactuated state and the seal bar 46 in closed position. Further, in this configuration the switch 100 is in an unlocked state such that upon release of the external force from a user the trigger 50 will spring back into the unactuated position, which, in turn, will result in the seal bar 46 moving or translating into its closed position, as shown in FIG. 8A. In other words, keeping the switch 100 in the unlocked state when the trigger 50 is actuated results in the seal bar 46 sliding back to its original closed state upon release of the external force from the trigger 50 as the trigger 50 returns to its unactuated state.

With respect to FIG. 8C, which is also a top view of the cap assembly 14, the seal bar 46 of the cap assembly 14 is illustrated in an open state and the switch 100 in a locked configuration. In this configuration, unlike that represented in FIG. 8B, the open position of the seal bar 46 is kept open in a continuous fashion once the switch 100 is slid into the locked configuration. That is, sliding the switch 100 in a locked position results in holding the seal bar 46 in a pulled-back or slid-back position, which, in turn, keeps the drink outlet 16 formed in a continuous manner. Once the switch 100 is slid into a locked state, the user may let go of the trigger 50, which allows the trigger 50 to return to its unactuated state, while the seal bar 46 is maintained in a pulled-back state, thereby forming the opening or the drink outlet 16 in the cap assembly 14.

In operation of the cap assembly 14, as shown with respect to FIGS. 8A-C, a user may squeeze or apply external force to the spring-loaded trigger 50, which opens up or forms the drink outlet 16 in the cap assembly 14. Further, to continue to keep the drink outlet 16 open without applying continued external force to the trigger 50, the user may slide the switch 100 in a locked state. This, in turn, will allow the drink outlet 16 to be in an open state in a continued manner without requiring further external force from the user. Doing so allows the user to vent a hot drink in the liquid container 12 without applying continuous external force to the trigger 50. However, if the user does not want to keep the drink outlet 16 open, the user will not slide the switch 100 in a locked state. This, in turn, will allow the drink outlet 16 to close after the external force on the trigger 50 is no longer applied. Or, alternatively, the user can slide the switch 100 back into the unlocked position from the locked position. By sliding the switch 100 into the unlocked position after being in the locked position will allow the seal bar 46 to slide forward and close the drink outlet 16 formed in the cap assembly 14. Stated differently, once the switch 100 is slid into the unlocked position and there is no further force being applied to the trigger 50, the seal bar 46 will revert back to the closed position.

Figure 9:
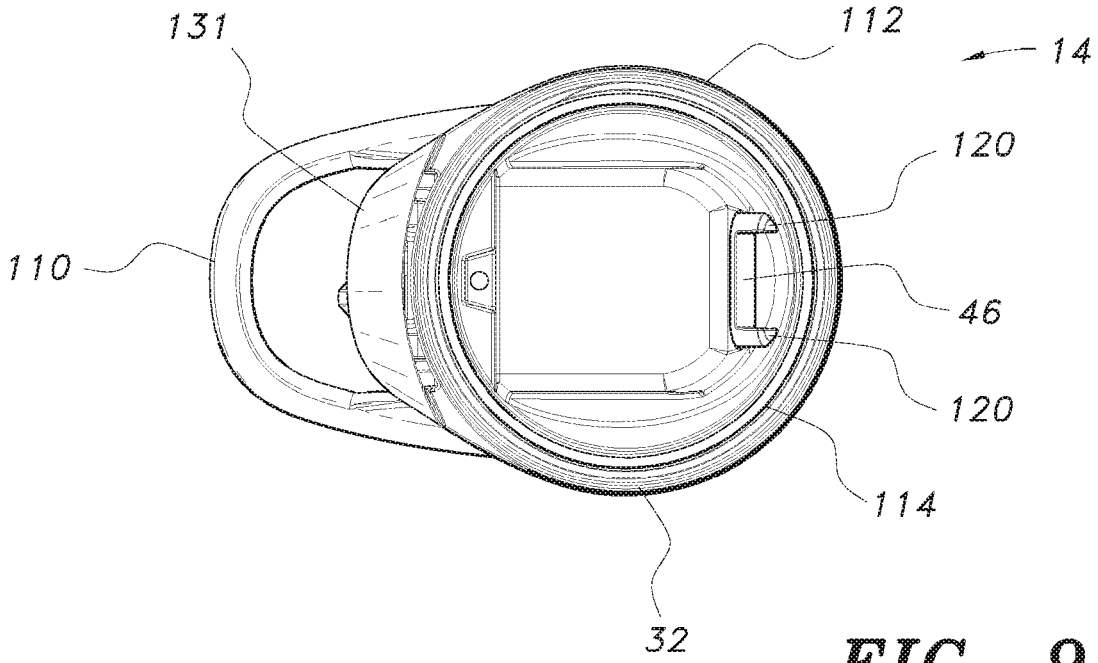
FIG. 9 is a bottom view of the cap assembly illustrated in FIG. 1A with the seal bar of the cap assembly in the closed state.
Figure 10:
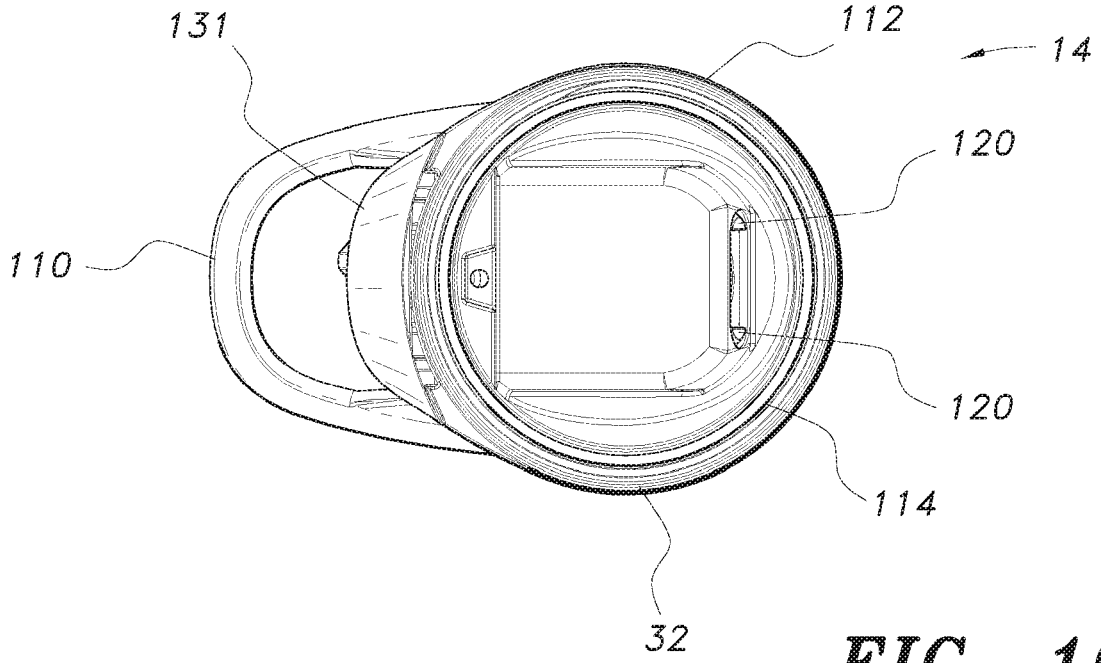
FIG. 10 is a bottom view of the cap assembly illustrated in FIG. 1A with the seal bar of the cap assembly in the open state.

Next, FIGS. 9-10 will be discussed. FIG. 9 is a bottom view of the cap assembly 14 illustrated in FIG. 1 with the seal bar 46 of the cap assembly 14 in the closed state. Whereas, FIG. 10 is a bottom view of the cap assembly 14 illustrated in FIG. 1 with the seal bar 46 of the cap assembly 14 in an open state. From the bottom view, one skilled in the art will appreciate that the handle 110 protrudes outward and away from the base of the cap assembly 14 in order to allow ease in gripping by a user. The bottom view of the cap assembly 14 further illustrates that the cap assembly 14 does not include any components, such as mechanical structures, in the bottom of the cap assembly 14. The only mechanical structures or components in the bottom of the cap assembly 14 are seal bar tines 120. Apart from the seal bar tines 120, which are generally proximal to the front end of the cap assembly 14, there are no other components or features in the bottom of the cap assembly 14.

Figure 11:
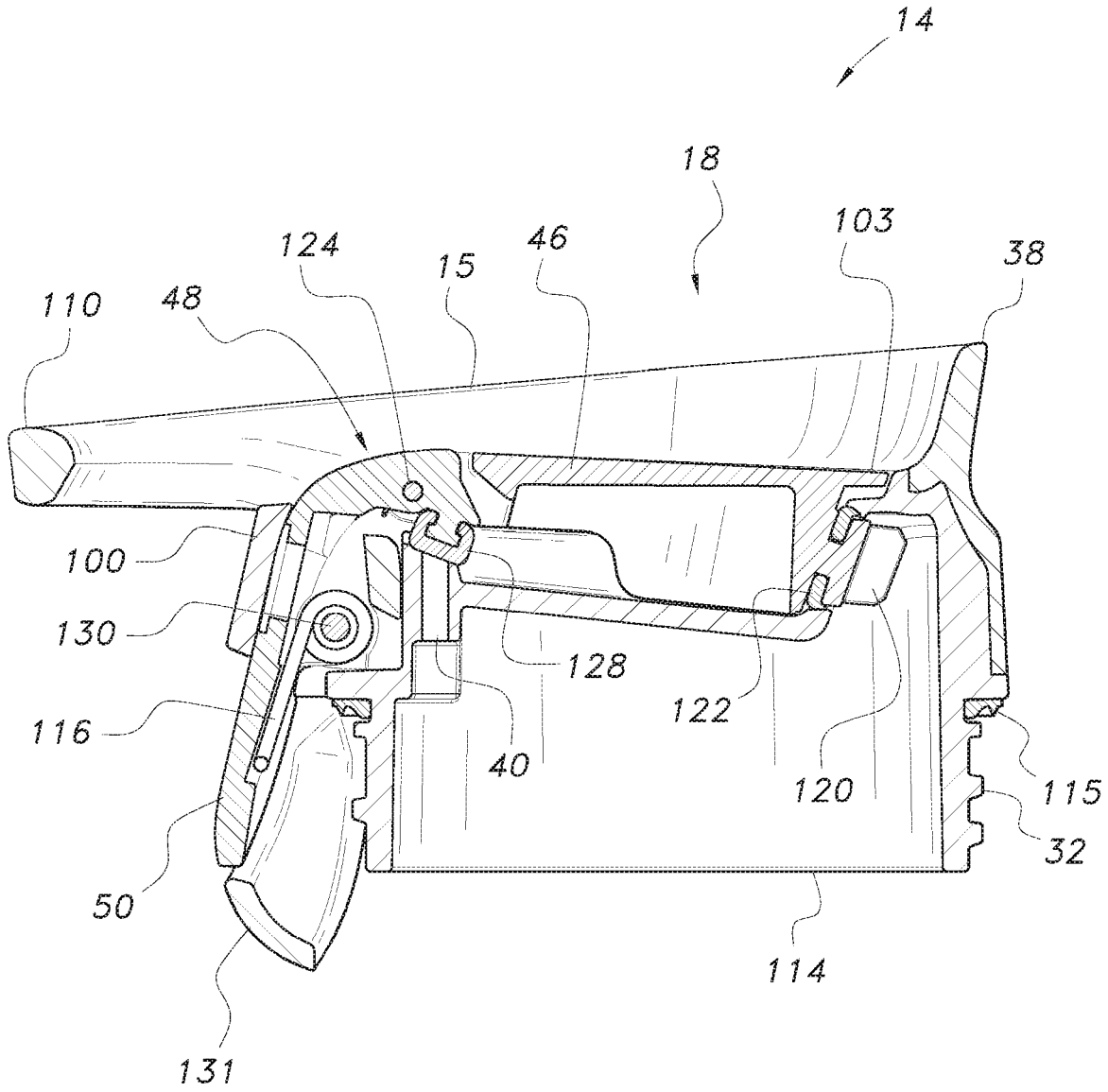
FIG. 11 is a cross-section of the cap assembly illustrated in FIG. 1A with the seal bar in the closed state and trigger of the cap assembly in an unactuated state.
Figure 12:
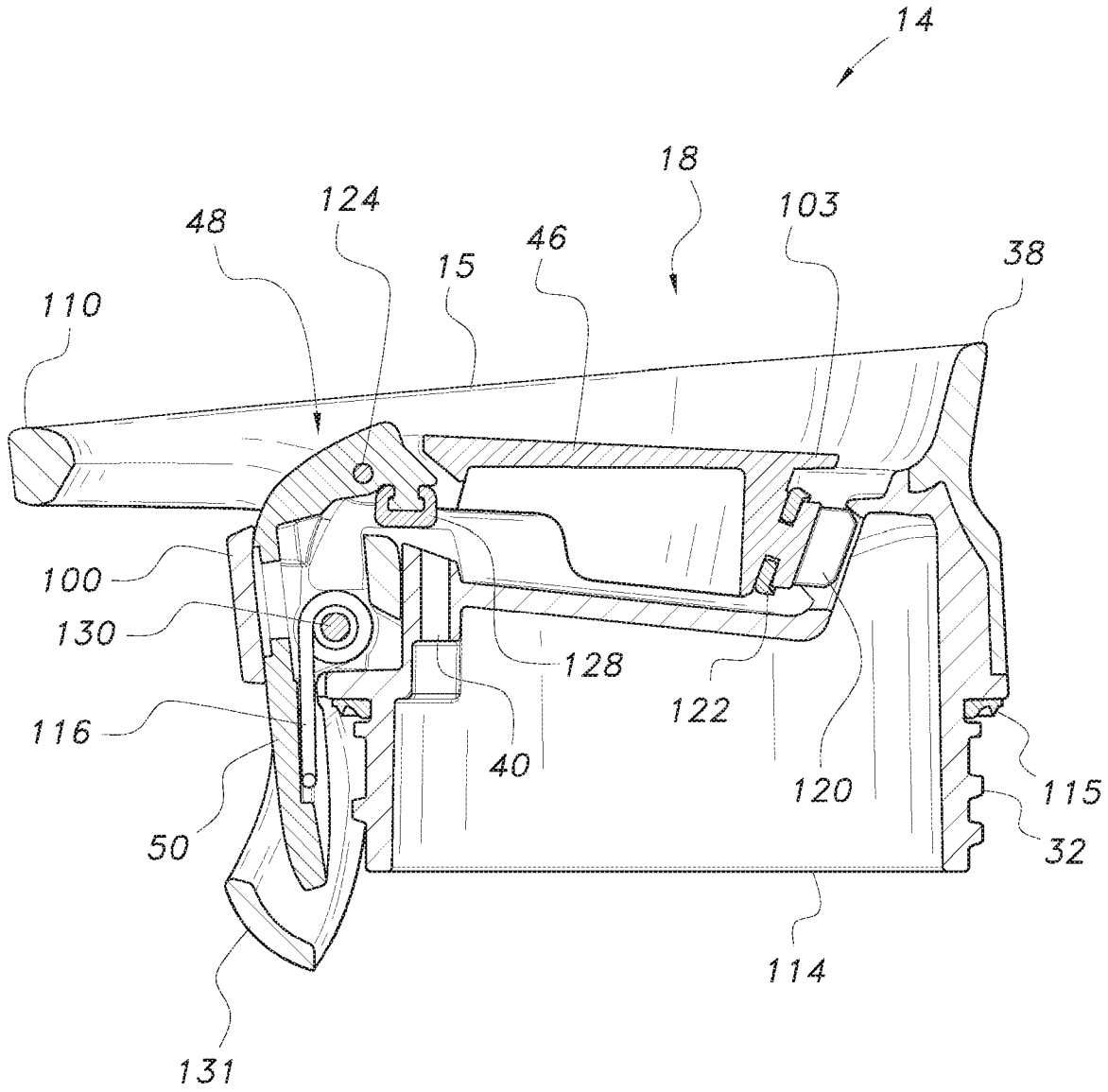
FIG. 12 is a cross-section of the cap assembly illustrated in FIG. 1A with the seal bar in the open state and the trigger of the cap assembly in an actuated state.

In other words, there are no springs, moving members, or other structural components that are in the bottom of the cap assembly 14. Instead, all the structural components that aid in the functioning of the cap assembly 14, which are further discussed below in reference to FIGS. 11-13, are on the outside of the bottom of the cap assembly 14. The underside or bottom of the cap assembly 14 is a single component that is a molded surface. Whereas, remaining structural components or features that aid in the translation of the seal bar 46, such as, inter alia, trigger 50, spring 116, axle 130, pin/axle 124, are separated from the bottom of the cap assembly 14. This is particularly advantageous as it provides greater ability to thoroughly clean the underside or bottom of the cap assembly 14 without letting additional structural components getting in the way. That is, with a generally hollow bottom surface in the cap assembly 14, the user has a greater flexibility in thoroughly cleaning the bottom of the cap assembly 14, which, as one skilled in the art will expect, will generally get dirtier as the drink liquid 24 may come in contact with it.

Figure 19A:
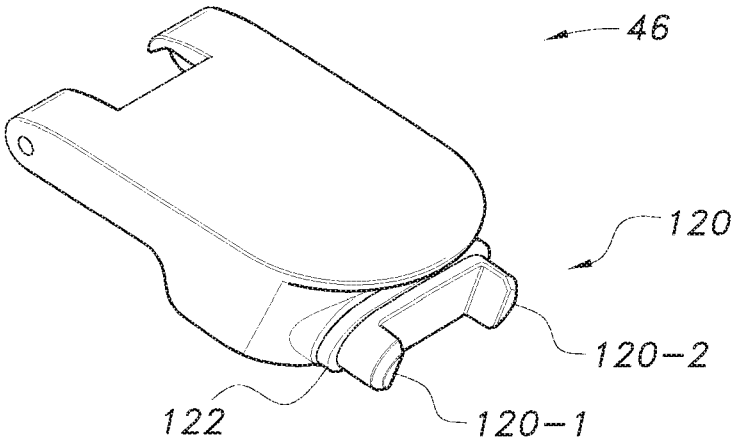
FIGS. 19A-B are perspective views of the seal bar and the seal bar tines forming the cap assembly as illustrated in FIG. 1A.
Figure 19B:
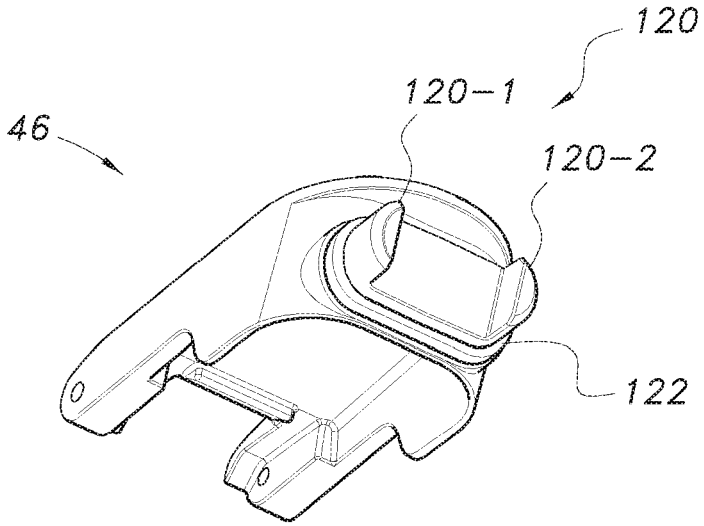

With respect to the seal bar tines 120 shown in FIGS. 9 and 10, the seal bar tines 120 extend from a distal region of the seal bar 46 as shown in detail in FIGS. 19A-B. The seal bar tines 120 are configured to seal the drink outlet 16, which is an opening formed upon retracting of the seal bar 46 when the trigger 50 is actuated. The structural details of the seal bar tines 120 will be discussed further below in reference to FIGS. 19A-B. With respect to FIG. 9, one skilled in the art will appreciate the seal bar tines 120 extending out and closing a drink outlet 16 as the seal bar 46 is in a closed state since the trigger 50 is in an unactuated state. Being in a closed state, the seal bar 46 closes the drink outlet 16, which in turn prevents a drink liquid 24 from flowing there through. Whereas in FIG. 10, one skilled in the art will appreciate the seal bar tines 120 being in a retracted state as the seal bar 46 is in an open state since the trigger 50 is in an actuated state. This configuration allows for the drink liquid 24 to flow there through from the drink outlet 16 that is formed in the cap assembly 14.

Next, FIG. 11 will be discussed which represents the cap assembly 14 in a closed configuration. FIG. 11 is a cross-section of the cap assembly 14 illustrated in FIG. 1A with the seal bar 46 in the closed state and the trigger 50 of the cap assembly in an unactuated state such that the seal bar tines 120 extending from the seal bar 46 are configured to seal the drink outlet 16. FIG. 11 illustrates the cap assembly 14 without being coupled to the liquid container 12. That is, FIG. 11 represents the cap assembly 14 by itself. As shown in this cross-section, the cap assembly 14 includes additional components that aid in the sliding of the seal bar 46 back when the trigger 50 is actuated in order to form a drink outlet 46. As shown from the cross-sectional view, the cap assembly 14 includes a spring 116, a pin or axle 130, a vent closure 48, pin/axle 124, a vent seal 128, and a vent 40.

The spring 116 is coupled to the trigger 50, wherein the trigger 50 is configured to be selectively pivoted by a user towards the liquid container 12 against the bias of a spring 116. The trigger 50 is pivotally coupled relative to the body of the cap assembly 14 via the pin or axle 130. The vent closure 48 includes a body that is integral to the trigger 50 and the vent seal or a sealing member 128 that is positioned on the body to selectively seal the vent 40. The vent seal or a sealing member 128 may be formed from silicone or another suitable sealing material. As such, when the trigger 50 is pivoted, or actuated upon application of an external force by a user, the vent closure 48 is automatically pivoted relative to the vent 40 and the vent seal or a sealing member 128 unseals the vent 40, as shown in FIG. 12. With respect to pin or axle 124, the seal bar 46 is rotationally coupled to the trigger 50 via the pin or axle 124 allowing the seal bar 46 to slide back or open out all the way as shown in FIGS. 12 and 13.

Next, FIG. 12 will be discussed which represents the cap assembly 14 in an open configuration. FIG. 12 is a cross-sectional view of the cap assembly 14 illustrated in FIG. 1A and is shown with the seal bar 46 in the open state and the trigger 50 of the cap assembly 14 also in an actuated state. As shown, in this configuration, the seal bar 46 is retracted or slid back upon actuation of the trigger 50. This allows the seal bar 46 to pivot with respect to the pin or axle 124, and the vent seal or the sealing member 128 to translate back. The sliding back of the sealing member 128 from its original position results in unsealing the vent 40, which allows ambient temperature air to flow from the outside environment into the liquid container 12 as further discussed below with respect to FIGS. 14A-B. In this configuration, the seal bar tines 120 are retracted back resulting in forming the drink outlet 16, which allows the user to access the drink liquid 24 inside the liquid container 12. In short, in the actuated position shown in FIG. 12, the seal bar 46 and the vent seal or the sealing member 128 are slid back, which in turn results in forming two openings—the drink outlet 16 and unsealing of the vent 40. This allows ambient temperature air to cool down the drink liquid 24 inside the liquid container 12.

Next, FIG. 13 will be discussed which represents the cap assembly 14 in a cleaning configuration. FIG. 13 is a cross-section of the cap assembly 14 illustrated in FIG. 1A in a cleaning mode state. As noted above with respect to FIG. 11, the cap assembly 14 is not coupled to or engaged to a liquid container 12. Instead, these illustrations represent the cap assembly 14 by itself. When the cap assembly 14 is not engaged with the liquid container 12, the user can further actuate the trigger 50 to prop open the cap assembly 46 all the way out as shown in FIG. 13. By doing so, it enables the user to clean the internal components of the cap assembly 14 that are underneath the seal bar 46. Without propping open the seal bar 46 all the way out as shown in FIG. 13, a user may be unable to effectively clean the internal components of the cap assembly 14 that are located beneath the seal bar 46. In other words, this rotational coupling between the seal bar 46 and the trigger 50 permits and/or provides for generally linear translation of the seal bar 46 when the operational assembly 18 reconfigures between the closed configuration and the open configuration. The rotational coupling also permits the seal bar 46 to be pivoted away from the drink outlet 16 and the body of the cap assembly 14 when the operational assembly 18 is configured to be in the cleaning configuration. The cleaning configuration shown in FIG. 13 permits cleaning around the vent 40 and the vent closure 48 as well. That is, as seen from FIG. 13, in the cleaning configuration mode the vent seal 128 does not seal the vent 40, which allows a user to clean the inner channel of the vent 40 along with the inner components of the cap assembly 14 that are below the seal bar 46.

Further, as seen in FIG. 13, once the seal bar 46 is propped open as discussed above, the trigger 50 may then go back to its unactuated position after the external user force is no longer applied thereto. That is, the user may no longer apply continuous external force in order to keep the trigger 50 in an actuated state for the seal bar 46 to be propped open in the cleaning configuration mode. The user may let go of the trigger 50 such that it reverts back to its original unactuated state as shown in FIG. 13, while the user cleans the internal components of the cap assembly 14, especially the vent 40 and portions of the cap assembly 14 underneath the seal bar 46.

Figure 14A:
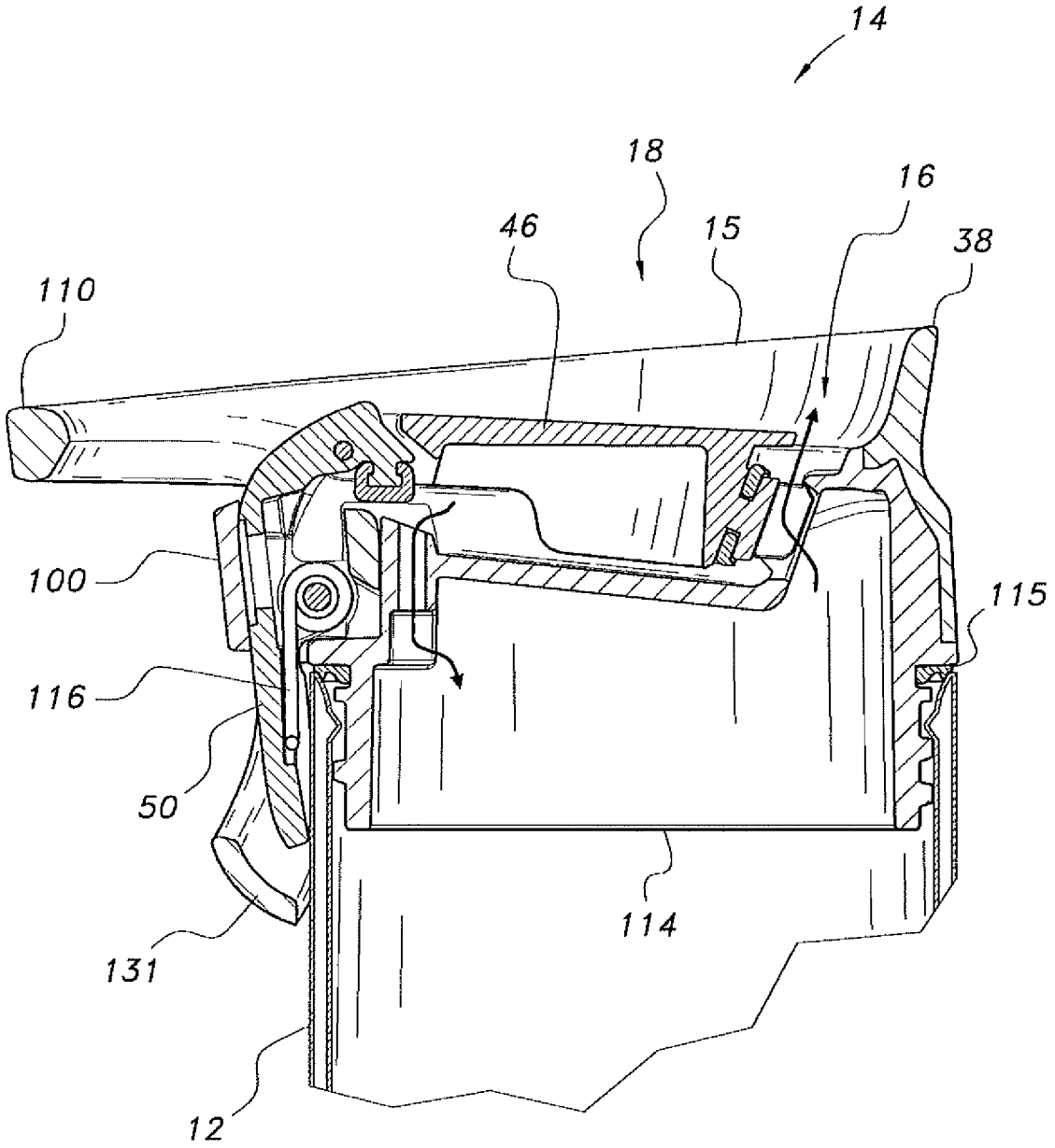
FIG. 14A is a cross-section of the cap assembly and the liquid container illustrated in FIG. 1A with the seal bar in the open state, the trigger of the cap assembly in the actuated state, and the switch in the unlocked configuration.
Figure 14B:
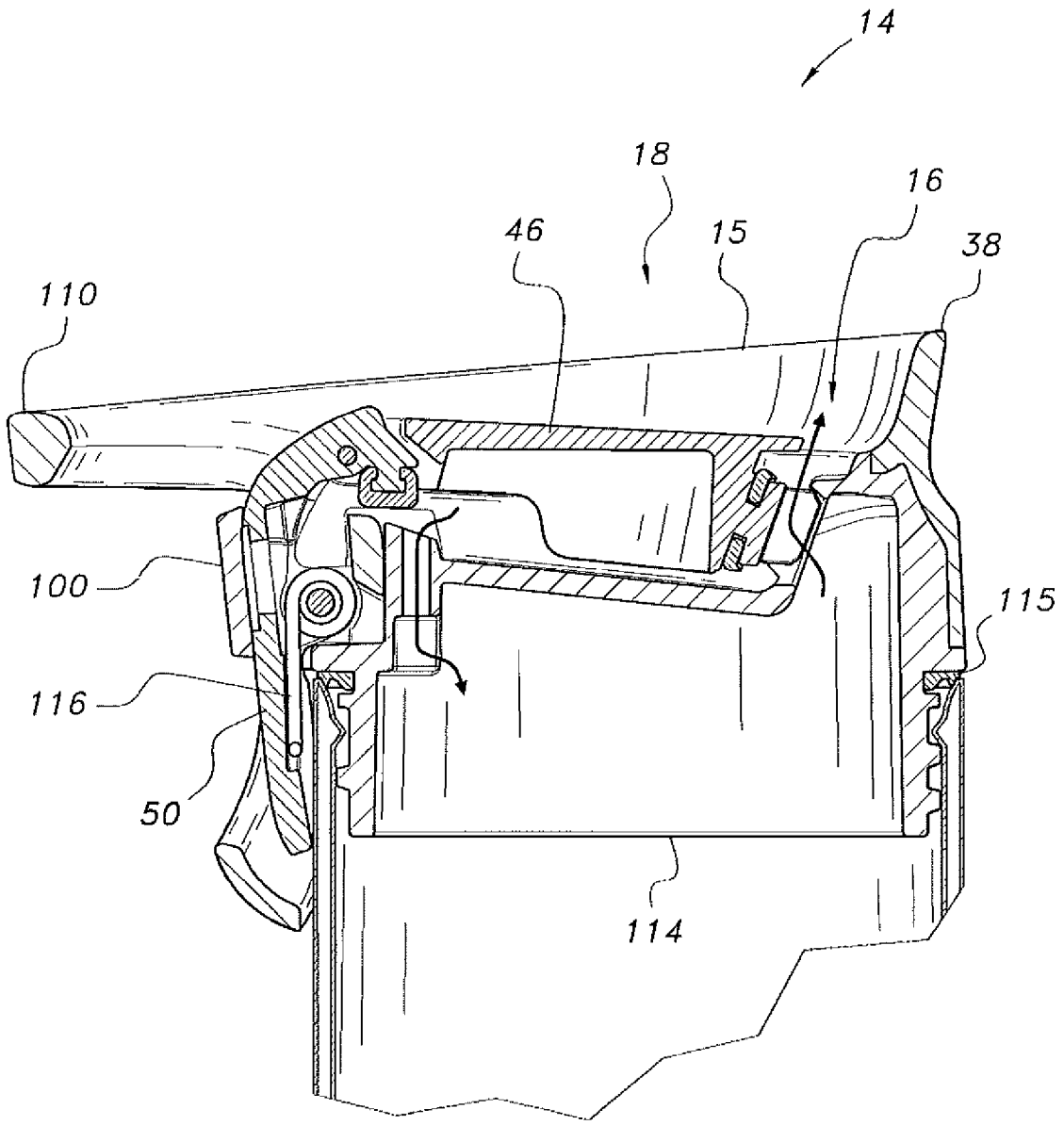
FIG. 14B is a cross-section of the cap assembly and the liquid container illustrated in FIG. 1A with the seal bar in the open state, the trigger of the cap assembly in the actuated state, and the switch in the locked configuration.

Next, FIGS. 14A-B will be discussed in detail. Both figures represent a cross-section of the cap assembly 14 and the liquid container 12 illustrated in FIG. 1A with the seal bar 46 in the open state. However, FIG. 14A represents the trigger 50 in an actuated state and the switch 100 in the unlocked position. Whereas, FIG. 14B represents the trigger 50 in an unactuated state and the switch 100 in the locked position. By having the switch 100 in the locked state and the trigger in the unactuated state allows the seal bar 46 to remain opened in a continuous manner. This allows the user to let go of the trigger 50 and not require further external pressure on the trigger 50. The switch 100 slid into the locked position keeps the seal bar 46 in an open state.

As shown in both FIGS. 14A-B, keeping the seal bar 46 open allows for air flow to pass there through, and in turn cool down a drink liquid 24 in the liquid container 12. As seen in FIGS. 14A and 14B, arrows represent air flow being maintained between outside of the liquid container 12 and inside of the liquid container 12. The two openings shown in FIGS. 14A-B pertain to an opening formed via the vent 40 and the drink outlet 46. As such, by sliding the switch 100 into a locked position the user can let go of the trigger 50 while letting his or her drink cool down as the seal bar 46 is kept in an open position.

Additionally, one skilled would appreciate that unlike FIGS. 11-13, here the cap assembly 14 is coupled to the liquid container 12. Upon actuating the trigger 50, it would face push back from the liquid container 12, which would prevent it from further actuation. That is, unlike FIG. 13 where the trigger 50 can be further actuated past a certain point because the cap assembly 14 is not coupled or engaged with the liquid container 12, in FIG. 14A the trigger 50 would be unable to do so as the liquid container 12 would prevent the trigger 50 from further actuation. As such, once engaged with the liquid container 12, the cap assembly 14 cannot achieve the cleaning configuration mode as shown in FIG. 13. That is, the trigger 50 would not be able to be further actuated due to the liquid container 12 coming in the way of the trigger 50.

Next, FIG. 15 will be discussed, which is a perspective front view of the cap assembly 14 illustrated in FIG. 1A in the cleaning mode. Similar to FIG. 13, discussed above, FIG. 15 represents the cap assembly 14, which is not coupled to a liquid container 12, in a cleaning mode configuration, as the seal bar 46 is propped open in order to allow for a user to clean internal components of the cap assembly 14. As shown, the seal bar 46 has a bottom portion with hollow cavity formed therein that sits on top of a top surface of the cap assembly 14. Further, the seal bar tines 120 are shown with two separate tips 120-1, 120-2. As discussed above, the seal bar tines 120 are configured to seal the drink outlet 16 when the seal bar 46 is in a closed state.

Figure 16:
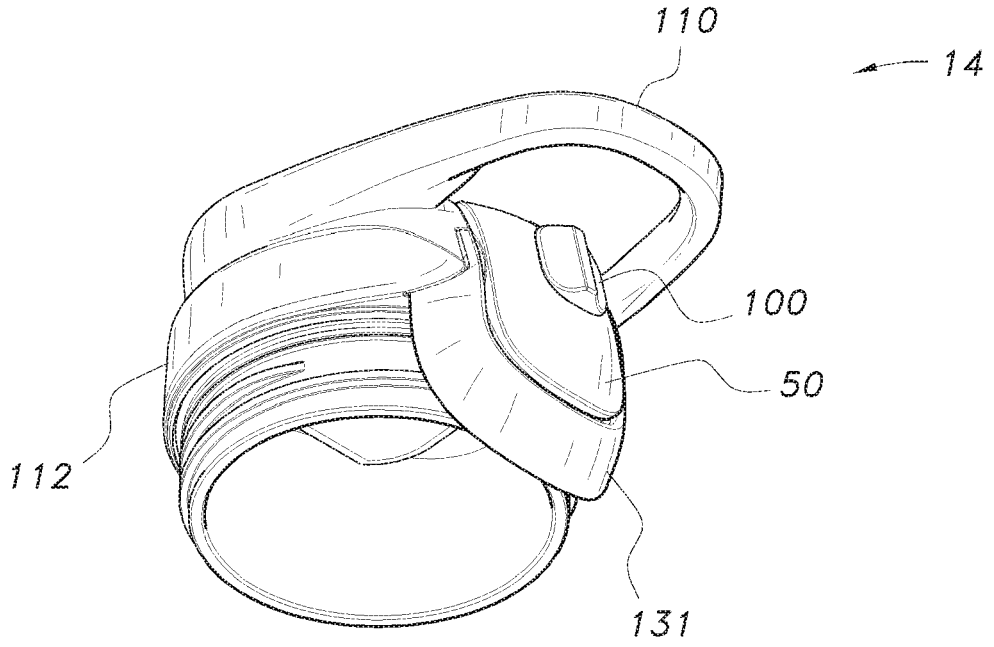
FIG. 16 is another perspective view of the cap assembly illustrated in FIG. 1A with the trigger in an unactuated state.

Next, FIGS. 16-17 will be discussed which are different perspective views of the cap assembly 14 illustrated in FIG. 1A. FIG. 16 illustrates a perspective view of the cap assembly 14 with the trigger 50 in an unactuated state. That is, no external force is applied to the trigger 50 by the user. As such, the trigger 50 nests within a u-shaped member 131. One skilled in the art will appreciate that FIG. 16 is another perspective view of the cap assembly 14 as shown in FIGS. 3A-B and 8A, for instance.

Figure 17:
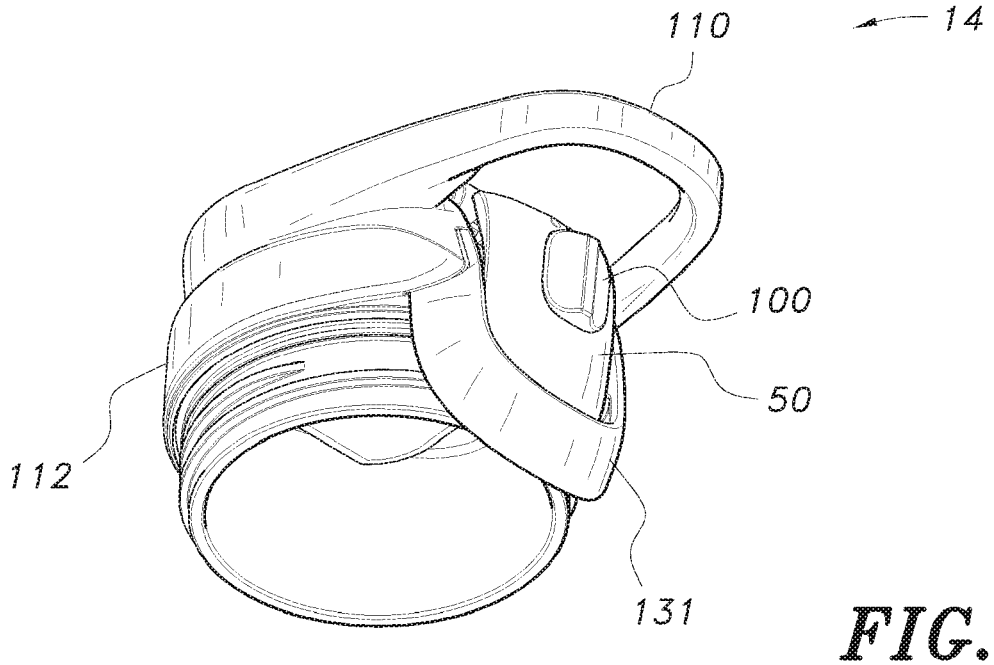
FIG. 17 is another perspective view of the cap assembly illustrated in FIG. 1A with the trigger in an actuated state.

In contrast, FIG. 17 represents the cap assembly 14 illustrated in FIG. 1 with the trigger 50 in the actuated state. That is, the user applies external force to the trigger 50 in order to pivot the trigger 50 relative to the u-shaped member 131. One skilled in the art will appreciate that FIG. 17 is another perspective view of the cap assembly 14 as shown in FIGS. 7A and 8B, for instance.

Next, FIG. 18 will be discussed. FIG. 18 is an exploded view of the cap assembly 14 illustrated in FIG. 1A. As shown, different components as discussed above form the cap assembly 14. The vessel gasket 115 is placed above the coupling structures 32 that serves to improve a seal between the cap assembly 14 with the liquid container 12 when operatively coupled together. The u-shaped member 131 is coupled to the body 15 of the cap assembly 14 via at least two screws 133, spaced apart from each other, that are screwed into the holes formed in the body 15 of the cap assembly 14. Received within the u-shaped member 131 is the trigger 50 that is pivotally coupled via the spring 116 and axle or pin 124.

The trigger 50 also contains switch 100 formed therein and at least two indicators 74 that correspond to a user whether the switch 100 is in locked or unlocked position. The trigger 50 is coupled to the seal bar 46 via an axle 130 and a cleaning position spring 102. The axle 130 is inserted through openings formed in the seal bar 46 and the trigger 50, and the cleaning position spring 102 is inserted on the axle 130. Such configuration allows the seal bar 46 to pivot or slide back, as discussed above with respect to FIG. 12, when the trigger 50 is actuated. Further, the seal bar 46 which has seal bar tines 120 extending therefrom has an O-ring or drink seal 122 formed around the seal bar tines 120. The O-ring or drink seal 122 is configured to seal the drink outlet 16 when the seal bar 46 is in a closed configuration.

Next, FIGS. 19A-B will be discussed. FIGS. 19A-B are perspective views of the seal bar 46 and the seal bar tines 120 forming the cap assembly 14 as illustrated in FIG. 1A. As shown in FIG. 19A, a top surface of the seal bar 46 is shown with seal bar tines 120 that include two tips 120-1, 120-2 that are separated from each other by a distance. Similarly, FIG. 19B represents a bottom surface of the seal bar 46 with seal bar tines 120. The two tips 120-1, 120-2 on the seal bar tines 120 are separated by a certain distance that corresponds to the width of the drink outlet 16. In turn, the seal bar tines 120 securely close the opening formed by the drink outlet 16 when the seal bar 46 is in a closed position, which prevents any spillage of the drink liquid 24 from the liquid container 12.

While the above detailed description has shown, described, and pointed out novel features of the disclosure as applied to various exemplary embodiments, it will be understood that various omissions, substitutions, and changes in the form and details of the device or process illustrated may be made by those skilled in the art without departing from the disclosure. The foregoing description is of the best mode presently contemplated of carrying out the disclosure. This description is in no way meant to be limiting, but, rather should be taken as illustrative of the general principles of the disclosure. The scope of the disclosure should be determined with reference to the claims.

While the disclosure has been illustrated and described in detail in the drawings and foregoing description, such illustration and description are to be considered illustrative or exemplary and not restrictive. The disclosure is not limited to the disclosed embodiments. Variations to the disclosed embodiments and/or implementations may be understood and effected by those skilled in the art in practicing the claimed disclosure, from a study of the drawings, the disclosure and the appended claims.

It should be noted that the use of particular terminology when describing certain features or aspects of the disclosure should not be taken to imply that the terminology is being re-defined herein to be restricted to include any specific characteristics of the features or aspects of the disclosure with which that terminology is associated. Terms and phrases used in this application, and variations thereof, especially in the appended claims, unless otherwise expressly stated, should be construed as open-ended as opposed to limiting. As examples of the foregoing, the term "including" should be read to mean "including, without limitation," "including but not limited to," or the like; the term "comprising" as used herein is synonymous with "including," "containing," or "characterized by," and is inclusive or open-ended and does not exclude additional, unrecited elements or method steps; the term "having" should be interpreted as "having at least;" the term "such as" should be interpreted as "such as, without limitation"; the term "includes" should be interpreted as "includes but is not limited to"; the term "example" is used to provide exemplary instances of the item in discussion, not an exhaustive or limiting list thereof, and should be interpreted as "example, but without limitation"; adjectives such as "known," "normal," "standard," and terms of similar meaning should not be construed as limiting the item described to a given time period or to an item available as of a given time, but instead should be read to encompass known, normal, or standard technologies that may be available or known now or at any time in the future; and use of terms like "preferably," "preferred," "desired," or "desirable," and words of similar meaning should not be understood as implying that certain features are critical, essential, or even important to the structure or function of the present disclosure, but instead as merely intended to highlight alternative or additional features that may or may not be utilized in a particular embodiment.

What is claimed is:

1. A cap assembly, comprising:

a seal bar extending along a top surface of the cap assembly and configured to translate between a forward position, in which the seal bar blocks a drink outlet on a proximal end of the cap assembly, and a back position, in which the seal bar exposes the drink outlet;

a trigger coupled to the seal bar on a rear end of the cap assembly opposite to the proximal end of the cap assembly, the trigger being configured to transition between a rest position and an actuated position based upon application of a force to the trigger to thereby translate the seal bar between the forward position and the back position; and a switch on the rear end of the cap assembly, the switch being positioned on an outer surface of the trigger, the switch configured to slide between a locked position and an unlocked position, wherein the seal bar is maintained in the back position to expose the drink outlet upon transitioning the trigger to the actuated position and subsequently sliding the switch in the locked position, wherein the seal bar comprises a bottom portion and a top portion, the top portion comprises a closed structure, and the bottom portion comprises a hollow cavity formed therein, the hollow cavity being formed between the top portion of the seal bar and the top surface of the cap assembly, and wherein the top portion of the seal bar is in contact with a drink spout upon the seal bar translating to the forward position.

2. The cap assembly of claim 1, wherein the seal bar is prevented from translating from the back position to the forward position upon the switch being slid into the locked position subsequent to transitioning of the trigger in the actuated position.

3. The cap assembly of claim 1, wherein the seal bar is configured to translate to the forward position upon the trigger being in the rest position and the switch in the unlocked position.

4. The cap assembly of claim 1, further comprising:

a vent positioned beneath a vent seal, the vent seal being configured to:

open the vent upon transitioning the trigger in the actuated position, and close the vent upon transitioning the trigger in the rest position, wherein the vent is maintained open upon the subsequent sliding of the switch in the locked position after transitioning of the trigger is in the actuated position.

5. The cap assembly of claim 1, wherein the switch comprises indentations for engagement by a user, the indentations are on the rear end of the cap assembly.

6. The cap assembly of claim 1, further comprising:

one or more status indicators on the rear end of the cap assembly and adjacent to the switch, the one or more status indicators corresponding to whether the switch is in the locked position or the unlocked position.

7. The cap assembly of claim 1, wherein the trigger comprises a top portion and a bottom portion, the switch being positioned between the top and bottom portions of the trigger, the bottom portion of the trigger being configured to transition towards the proximal end of the cap assembly and away from the top portion of the trigger in the actuated position.

8. The cap assembly of claim 1, wherein the seal bar comprises a pair of seal bar tines configured to engage the drink outlet upon the seal bar translating in the forward position, the pair of seal bar tines corresponding to projections that are spaced apart from each other.

9. The cap assembly of claim 8, wherein the pair of seal bar tines are configured to extend towards the proximal end of the cap assembly and away from the switch and the trigger upon the pair of seal bar tines engaging the drink outlet.

10. The cap assembly of claim 1, further comprising:

a handle extending away from the proximal end of the cap assembly, the handle forming an opening between the switch and a proximal portion of the handle.

11. A cap assembly, comprising:

a seal bar extending along a top surface of the cap assembly and configured to translate between a forward position, in which the seal bar blocks a drink outlet on a proximal end of the cap assembly, and a back position, in which the seal bar exposes the drink outlet;

a trigger coupled to the seal bar on a rear end of the cap assembly opposite to the proximal end of the cap assembly, the trigger being configured to transition between a rest position and an actuated position based upon application of a force to the trigger to thereby translate the seal bar between the forward position and the back position; and a switch on the rear end of the cap assembly, the switch being positioned on an outer surface of the trigger, the switch configured to slide between a locked position and an unlocked position, wherein the seal bar is maintained in the back position to expose the drink outlet upon transitioning the trigger to the actuated position and subsequently sliding the switch in the locked position, wherein the trigger comprises a top portion and a bottom portion, and wherein the switch is positioned between the top and bottom portions of the trigger, the bottom portion of the trigger being configured to transition towards the proximal end of the cap assembly and away from the top portion of the trigger in the actuated position.

12. The cap assembly of claim 11, further comprising:

a handle extending away from the proximal end of the cap assembly, the handle forming an opening between the switch and a proximal portion of the handle.

13. The cap assembly of claim 11, wherein the seal bar is prevented from translating from the back position to the forward position upon the switch being slid into the locked position subsequent to transitioning of the trigger in the actuated position.

14. The cap assembly of claim 11, wherein the seal bar is configured to translate to the forward position upon the trigger being in the rest position and the switch in the unlocked position.

15. The cap assembly of claim 11, further comprising:

a vent positioned beneath a vent seal, the vent seal being configured to:

open the vent upon transitioning the trigger in the actuated position, and close the vent upon transitioning the trigger in the rest position, wherein the vent is maintained open upon the subsequent sliding of the switch in the locked position after transitioning of the trigger in the actuated position.

16. The cap assembly of claim 11, wherein the switch comprises indentations for engagement by a user, the indentations are on the rear end of the cap assembly.

17. The cap assembly of claim 11, further comprising:

one or more status indicators on the rear end of the cap assembly and adjacent to the switch, the one or more status indicators corresponding to whether the switch is in the locked position or the unlocked position.

18. The cap assembly of claim 11, wherein the switch is configured to transition towards the proximal end of the cap assembly upon the bottom portion of the trigger transitioning towards the proximal end of the cap assembly.

19. The cap assembly of claim 11, wherein the seal bar comprises a pair of seal bar tines configured to engage the drink outlet upon the seal bar translating in the forward position, the pair of seal bar tines corresponding to projections that are spaced apart from each other.

20. The cap assembly of claim 19, wherein the pair of seal bar tines are configured to extend towards the proximal end of the cap assembly and away from the switch and the trigger upon the pair of seal bar tines engaging the drink outlet.

* * * * *